US007293519B2

(12) United States Patent
Montgomery et al.

(10) Patent No.: US 7,293,519 B2
(45) Date of Patent: Nov. 13, 2007

(54) MOORING SYSTEM WITH ACTIVE CONTROL

(75) Inventors: Peter James Montgomery, Christchurch (NZ); Bryan John Rossiter, Christchurch (NZ)

(73) Assignee: Cavotec MSL Holdings Limited, Christchurch (NZ)

( * ) Notice: Subject to any disclaimer, the term of this patent is extended or adjusted under 35 U.S.C. 154(b) by 21 days.

(21) Appl. No.: 10/522,868

(22) PCT Filed: Jul. 30, 2003

(86) PCT No.: PCT/NZ03/00167

§ 371 (c)(1),
(2), (4) Date: Aug. 4, 2005

(87) PCT Pub. No.: WO2004/011326

PCT Pub. Date: Feb. 5, 2004

(65) Prior Publication Data

US 2006/0081166 A1 Apr. 20, 2006

(30) Foreign Application Priority Data

Jul. 30, 2002 (NZ) ..... 520450

(51) Int. Cl.
*B63B 21/00* (2006.01)

(52) U.S. Cl. ..... 114/230.1

(58) Field of Classification Search ..... 114/230.1, 114/230.15, 230.17, 230.18, 230.19
See application file for complete search history.

(56) References Cited

U.S. PATENT DOCUMENTS 3,227,481 A 1/1966 Creskoff
3,322,091 A 5/1967 Stanwick
3,463,114 A 8/1969 Lovell
3,974,794 A 8/1976 Kakitani et al.
4,055,137 A 10/1977 Motai et al.
4,532,879 A 8/1985 Ortloff
4,543,070 A 9/1985 Olsen et al.
4,549,835 A 10/1985 Ando et al.

(Continued)

FOREIGN PATENT DOCUMENTS

DE 1911949 10/1970

(Continued)

*Primary Examiner*—Lars A. Olson
*Assistant Examiner*—Daniel V. Venne
(74) *Attorney, Agent, or Firm*—Knobbe, Martens, Olson & Bear LLP

(57) ABSTRACT

A vessel mooring system which includes at least two mooring robots secured to a terminal, each robot includes an attractive force attachment element eg. a vacuum cup and a base structure fixed relative to the terminal. The attachment element is able to be engaged with a vertically extending side vessel surface and to exert an attractive force normal to the vessel surface at where it is to be attached. Each robot can measure the attractive force between the attachment element and the vessel to provide an "attractive force capacity reading". Also provided is capability to measure the force between the attachment element and the fixed structure of the mooring robot to provide a "normal force reading". From monitoring of the relationship between the attractive force capacity reading and the normal force a control of the mooring robot can be provided such that if there is a tending to separate the attachment elements from said vessel the attractive force may be increased and/or alarm is sounded.

43 Claims, 25 Drawing Sheets

U.S. PATENT DOCUMENTS

| | | | | |
|---|---|---|---|---|
| 4,852,926 | A | 8/1989 | Littell | |
| 5,154,561 | A * | 10/1992 | Lee | 414/138.3 |
| 5,676,085 | A | 10/1997 | Michl, Jr. | |
| 6,439,147 | B2 | 8/2002 | Cottrell et al. | |
| 2004/0154518 | A1 | 8/2004 | Hadcroft et al. | |

FOREIGN PATENT DOCUMENTS

| | | |
|---|---|---|
| DE | 25 57 964 | 12/1976 |
| DE | 92 07 648.3 | 10/1992 |
| FR | 2 672 650 | 8/1992 |
| GB | 1 491 511 | 11/1977 |
| JP | 55-44057 | 3/1980 |
| JP | 58-206478 | 12/1983 |
| JP | 61-218495 | 9/1986 |
| JP | 7-33075 | 2/1995 |
| JP | 8-34388 | 2/1996 |
| NL | 8600973 | 11/1987 |
| WO | WO 91/14615 | 10/1991 |
| WO | WO 98/17868 | 4/1998 |
| WO | WO 01/62584 | 8/2001 |
| WO | WO 01/62585 | 8/2001 |

* cited by examiner

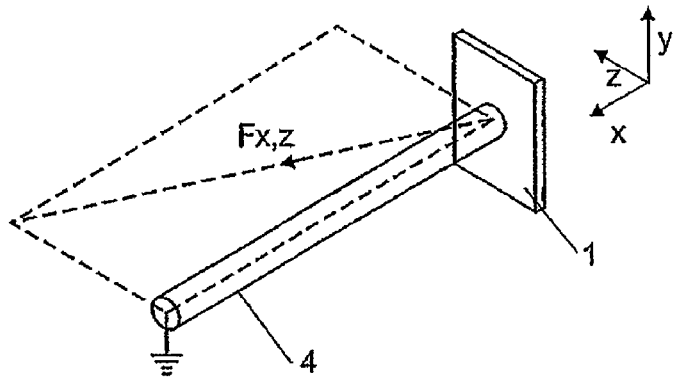
FIGURE 7
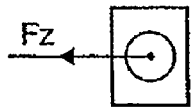
FIGURE 8
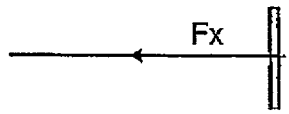
FIGURE 9
FIGURE 10
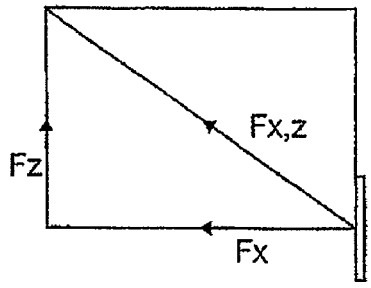

FIGURE 11
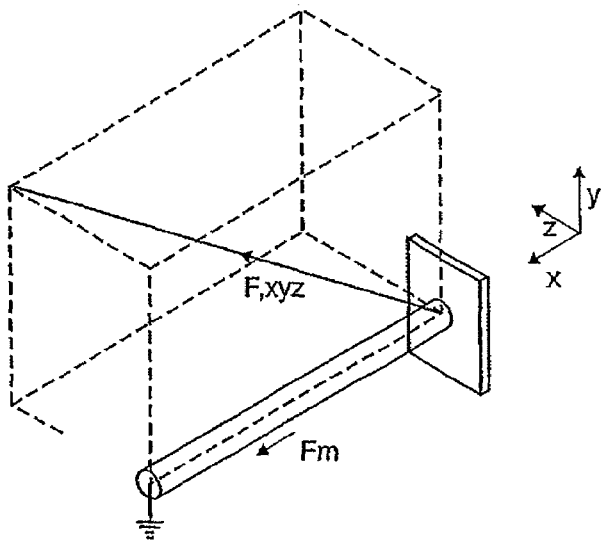
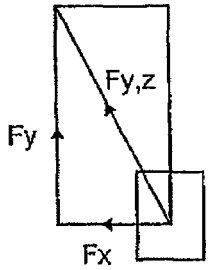
FIGURE 12
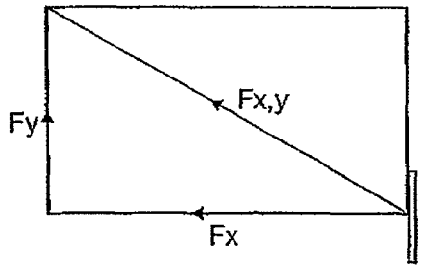
FIGURE 13
FIGURE 14
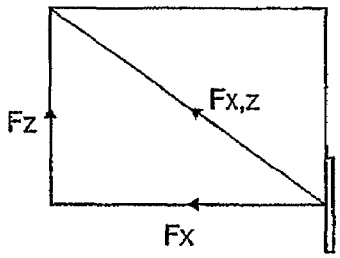

FIGURE 15
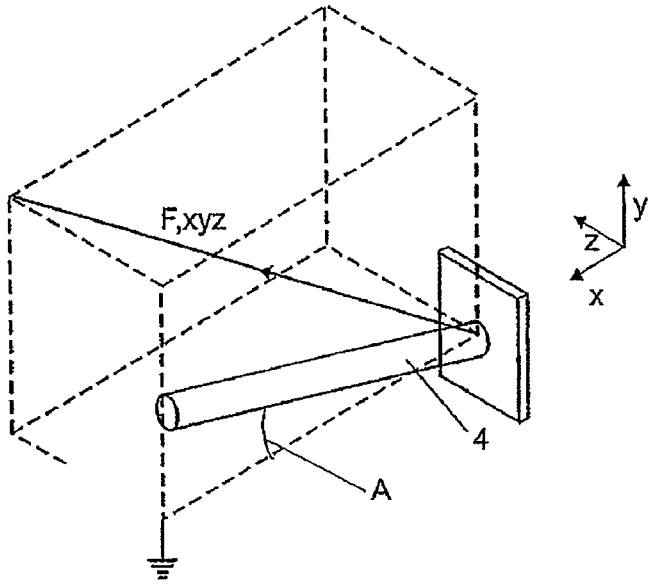
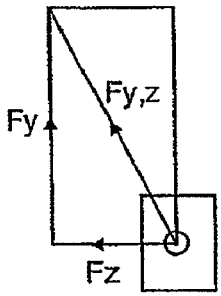
FIGURE 16
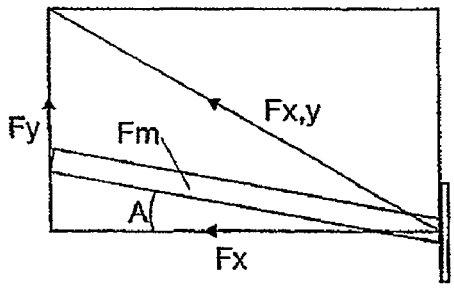
FIGURE 17
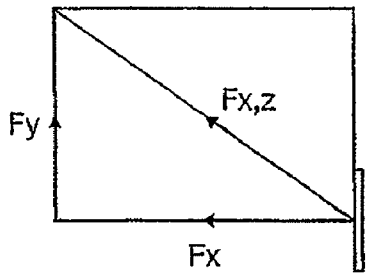
FIGURE 18

FIGURE 40
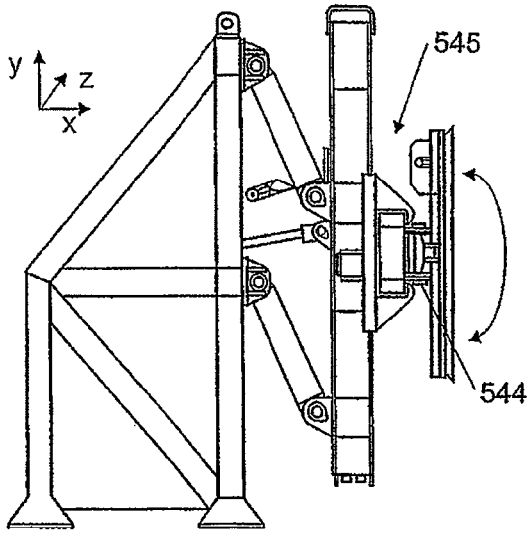
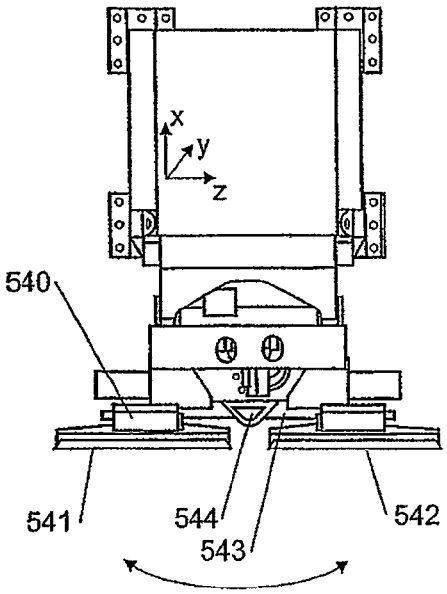
FIGURE 41
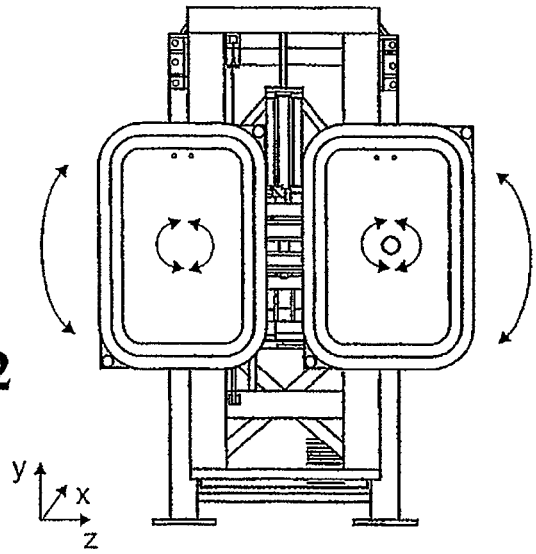
FIGURE 42

MOORING SYSTEM WITH ACTIVE CONTROL

RELATED APPLICATIONS

This application is a national phase entry in the United States of the International Application PCT/NZ2003/000167 filed Jul. 30, 2003 and claims the benefit of the New Zealand Application 520450 filed Jul. 30, 2002.

BACKGROUND OF THE INVENTION

1. Technical Field

The present invention relates to a vessel mooring system with active control and more specifically to a system for monitoring mooring loads applied to and displacement of a vessel. In particular although not solely the invention relates to the control of a mooring system employing mooring robots having an attractive attachment element for engagement with a surface for making fast the ship.

2. Background Art

The mooring of a ship at a terminal such as a dock utilising mooring robots is known. Automated systems such as these are described for example in WO 0162585 and have a number of advantages over conventional methods of mooring employing mooring lines.

When a ship is approaching the terminal mooring robots are able to secure a ship and subject it to large forces within a reasonably short time to counter any significant dynamic forces in order to reduce movement of the ship and thereby bring it under precise control into a desired position relative to the terminal. However, a problem which any mooring system must counter is the effect of water currents and wind which tend to apply forces to a ship in a direction which may encourage the ship out of contact with the mooring robots. This introduces important safety consideration in the design of robotic systems employing attractive attachment elements such as vacuum cups. In considering environmental aspects, it is desirable to provide a high level of safety while also avoiding over-design and excessive redundancy.

Failure in the mooring of a vessel with a vacuum cup style mooring robot occurs when the forces applied to a vessel in a direction tending to release the vessel from the vacuum cups exceed the suction force of the vacuum cups on the vessel. This holding force can vary according to the degree of suction that is applied by the pneumatic suction system. The size of the holding force and hence the holding capacity applied by the mooring robots to the vessel can hence vary. In more traditional forms of mooring using mooring lines, the holding capacity provided by the mooring lines is determined by the break strength of the mooring lines or the strength of the fixtures holding the mooring lines between the vessel and the shore.

In conventional mooring methods employing mooring lines, various methods have been proposed for monitoring the mooring loads and controlling the mooring system to avoid catastrophic failure. For example, the magnitude of the tensile loads in the mooring lines have in previous methods been monitored to control automatic mooring winches. For example U.S. Pat. No. 4,055,137 describes the use of tension detectors to determine the tension force within a mooring line connected between a wharf and a vessel. Such information is used to control the winches to make adjustments to the tension of the mooring lines as desired. The system of U.S. Pat. No. 4,055,137 may however only be relied upon to ensure that certain limits of force within the mooring lines are not exceeded. Such limits are fixed dependent on the tensile strength of the mooring lines or fixtures in question. Since such tensile strength limits do not vary over time and cannot vary over time the information gained from the forces within the mooring lines relate only to the determination of the ultimate maximum breaking strength of the mooring. Furthermore since there is no measurement of angles of force between the vessel and the mooring lines it is not possible to utilise the system of U.S. Pat. No. 4,055,137 to determine the total force being applied to the vessel in for example the athwartship direction and longitudinal direction. Furthermore in light of there being no angular or displacement measurements being provided by the system described in U.S. Pat. No. 4,055,137 the invention of U.S. Pat. No. 4,055,137 does not allow for accurate position information to be provided as part of the system. The system of U.S. Pat. No. 4,055,137 is also unable to provide mooring load data while the vessel is moving relative to the terminal, since the system is not designed to purposefully move a ship.

U.S. Pat. No. 4,532,879 describes a mooring robot which is directly coupled to a vessel. Like U.S. Pat. No. 4,055,137, no vacuum connection is provided. Whilst a mooring force is measured in one direction only by the mooring robot of U.S. Pat. No. 4,532,879 the purposes for such is to restore the positioning of the vessel relative to the mooring robot. The force is measured to control a hydraulic pressure system to provide such restorative force. Since the ultimate holding capacity of the mooring robot is determined from the strength of the physical structure there is no need for a control of the mooring force dependent on any variation in ultimate holding strength of the coupling between the ship and the mooring robot since there is no such variation. Furthermore the mooring robot of U.S. Pat. No. 4,532,879 is capable only of measuring forces in one direction since the robot is free rotating about a pivot point. Since the mooring robot provides no lateral constraints to the ship this system is analogous to the measurement of force in a mooring line as for example shown in U.S. Pat. No. 4,055,137.

Our own prior publication of WO02/090173 describes a mooring robot however no reference is made to a relationship existing between the variable vacuum cup holding force and the forces measured by the mooring robot in at least the athwartship and longitudinal directions.

A further issue in respect of the monitoring of forces and displacements in a mooring line mooring system is the fact that such mooring lines are often elastic in nature. Accordingly no absolute determination of forces and positioning can be measured in such an elastic coupling. Whilst measurements of the mooring lines can be achieved to provide absolute information thereof, it is not an instantaneous reflection of the loading and position of the vessel.

Accordingly some of the prior art systems as described above utilise the force measurement provisions for ensuring the maintenance of the mooring system to within limits of self destruction. This is so because of the direct mechanical coupling of the vessel with the mooring robots to the wharf.

Moreover the accuracy achievable with the mooring line prior art systems is limited by the properties of the mooring lines, which may interfere with one another or with bollards etc to produce anomalous effects which cannot be readily measured.

It is accordingly an object of the present invention to provide a mooring system with active control which address the foregoing needs and problems or at least to provide the public with a useful choice.

Further aspects and advantages of the present invention will become apparent from the ensuing description which is given by way of example only.

DISCLOSURE OF INVENTION

Accordingly in a first aspect the invention includes a method of controlling a vessel mooring system said system including at least one mooring robot for releasably fastening a vessel floating at the surface of a body of water to a terminal, the mooring robot including an attractive force attachment element displaceably engaged to a base structure of said mooring robot said base structure affixed to said terminal, said attractive force attachment element being releasably engagable with a vessel surface for making fast the vessel with said terminal, the mooring robot providing active translational movement of the attractive force attachment element relative to the base structure to allow thereby the movement of a vessel in a direction selected from any one or both of (i) an athwartship direction, and (ii) a longitudinal direction, said method, after the associating of the vessel with the mooring system by allowing the vessel surface to be engaged by the attractive force attachment element and the establishing of an attraction between said vessel and said mooring robot, comprises;

(a) measuring the attractive force between the surface and the attractive force attachment element, for the purposes of determining the holding capacity in at least one of (i) parallel to the attractive force direction, (ii) normal to the attractive force direction and horizontally, and (iii) normal to the attractive force direction and vertical, (b) measuring the force between the attractive force attachment element and the base structure of the mooring robot at least in a direction selected from anyone or more of (i) parallel to the attractive force direction, (ii) normal to the attractive force direction and horizontally, and (iii) normal to the attractive force direction and vertical, (c) monitoring the relationship between the attractive force and the force(s) measured in (b), wherein an alarm is triggered when any one or more of the forces measured in (b), in a direction to tend toward allowing relative movement between the attractive force attachment element and the said vessel, approaches an attractive force dependent holding capacity in the direction to tend towards allowing relative movement of the attractive force attachment element with said vessel.

Preferably said attractive force attachment element is a variable attractive force attachment element and the method further includes, when any one or more of the forces measured in (b) reach a predefined limit tending toward allowing relative movement between the variable force attractive element and the said vessel in a direction parallel to such force(s) measured, the controlling to increase the attractive force between the vessel surface and the variable attractive force attachment element in response to the force (s) measured in (b).

Preferably said attractive force attachment element is a variable attractive force attachment element and the method further includes, when any one or more of the forces measured in (b) reach a predefined limit tending toward allowing relative movement between the variable force attractive element and the said vessel in a direction parallel to such force(s) measured, the controlling to increase the attractive force between the vessel surface and the variable attractive force attachment element proportional to the force (s) measured in (b).

Preferably said attractive force attachment element is a variable attractive force attachment element and the method further includes, when any one or more of the forces measured in (b) reach a predefined limit tending toward allowing relative movement between the variable force attractive element and the said vessel in a direction parallel to such force(s) measured, the controlling by increasing of the attractive force between the vessel surface and the variable attractive force attachment element when the force (s) measured in (b) reaches a maximum limit of a predetermined range.

Preferably wherein the force(s) measured in (b) between the attractive force attachment element and the base structure is continuously monitored and determined from a signal responsive to a transducer, wherein said signal responsive to said transducer is displayed on the vessel visually, to indicate the force (s) between vessel and said fixed structure of said mooring robot.

Preferably said system included a plurality of spaced apart mooring robots, each presenting an attractive force attachment element to engage to a surface of said vessel and wherein the force(s) as measured in (b) between the attractive force attachment element and the base structure of each mooring robot is continuously monitored and determined from a signal responsive to a transducer, wherein said signal responsive to said transducer is displayed on the vessel visually, to indicate the force (s) between vessel and said fixed structure of said mooring robot.

Preferably said system included a plurality of spaced apart mooring robots, each presenting an attractive force attachment element to engage to a surface of said vessel, wherein said method further includes, when any one or more of the forces measured in (b) of one of said mooring robots tends toward allowing relative movement between the attractive force attachment element and the said vessel in a direction parallel to such force(s) measured by such approaching a holding capacity of the attractive force attachment element in any such direction, at least one of the other mooring robots is controlled for movement of its attractive force attachment element relative to said fixed base in a direction to vary the force between its attractive force attachment element and its base structure in a direction opposite to such said direction to thereby reduce the force in such said direction between the attractive force attachment element and its said base structure of said one mooring robot.

Preferably said system included a plurality of spaced apart mooring robots, each presenting a variable attractive force attachment element to engage to a surface of said vessel, wherein said method further includes, when any one or more of the forces measured in (b) of one of said mooring robots tends toward allowing relative movement between the variable force attractive element and the said vessel in a direction parallel to such force(s) measured by such approaching a holding capacity of the attractive force attachment element in any such direction, at least one of the other mooring robots is controlled to increase its attractive force.

Preferably wherein the attractive force between each attractive force attachment element and the vessel surface is measured and a signal corresponding to the measured attractive force is transmitted for the purpose of its display on the vessel.

Preferably wherein the attractive force between said attractive force attachment element and the vessel surface is measured and a signal corresponding to the measured attractive force is transmitted for the purpose of comparison with the measured force(s) of (b), wherein an alarm is triggered when any one or more of the forces measured in (b) reaches a proportion of a force required to result in relative movement between said attractive force attachment element and said vessel, which holding force is dependent on attractive force measured.

Preferably wherein the attractive force between said attractive force attachment element and the vessel surface is measured and a signal corresponding to the measured attractive force is transmitted for the purpose of comparison with the measured force(s) of (b), wherein the attractive force is increased when any one or more of the forces measured in (b) reaches a limit corresponding a force (holding force) required to result in relative movement between said attractive force attachment element and said vessel, which holding force is dependent on attractive force measured.

Preferably wherein the attractive force attachment element is of a kind to be engaged with a planar surface of said vessel with its attractive force acting normal only to said planar surface, wherein the attractive force between each attractive force attachment member and the planar surface is measured and a signal corresponding to the measured attractive force is transmitted for the purpose of comparison with the force measured in (b) (ii) wherein an alarm is triggered when such force in a direction to tend toward resulting in a relative movement of said attractive force attachment member and said vessel in the direction parallel to the force measured in (b) (ii), approaches the holding capacity of said attractive force attachment member with said vessel as determined from the measured attractive force.

Preferably wherein the attractive force attachment element is of a kind to be engaged with a planar surface of said vessel with its attractive force acting normal only to said planar surface and is of a variable attractive force attachment element, wherein the attractive force between each attractive force attachment member and the planar surface is measured and a signal corresponding to the measured attractive force is transmitted for the purpose of comparison with the force measured in (b) (ii) wherein when such force in a direction reaches a predefined limit tending toward resulting in a relative movement of said attractive force attachment member and said vessel in the direction parallel to the force measured in (b) (ii), approaches the holding capacity of said attractive force attachment member with said vessel, the attractive force is increased.

Preferably wherein when the force between the mooring robot and the vessel parallel to the direction of force measured in (b) (i) tends toward resulting in a separation of said attractive force attachment element from said vessel, exceeds a first threshold the mooring robot adopts a safe mode wherein the attractive force between the vessel surface and the attractive force attachment element changes to a maximum attractive force.

Accordingly in a second aspect the invention comprises a vessel mooring system which includes at least two mooring robots secured to a terminal, the terminal being either a fixed or floating structure each mooring robot including an attractive force attachment element displaceably engaged to a base structure of said mooring robot said base structure fixed relative to the terminal, said attractive force attachment element to be releasably engaged with a substantially vertically extending port or starboard side disposed vessel surface for making fast the vessel to said terminal, said attractive force attachment element capable of exerting an attractive force normal to said vessel surface at which it is to be attached, means to establish the attractive force between said vessel and said attractive force attachment element wherein each mooring robot includes means to actuate movement of the attractive force attachment element relative to the base structure in at least a direction selected from any one or both of an athwartship direction and longitudinal direction and wherein for each robot, said system further including (a) means to measure the attractive force between the attractive force attachment element and the vessel in a direction parallel to said normal to provide an "attractive force capacity reading" and (b) means to measure the force between said attractive force attachment element and the base structure of said mooring robot in at least any one or more of:

i. a direction parallel to the said normal to provide a "normal force reading"

ii. a direction horizontal and perpendicular to said normal to provide a "horizontal shear force reading", and iii. a direction vertical and perpendicular to the normal to provide a "vertical shear force reading"

(c) means to monitor the relationship between said attractive force capacity reading and any one or more of said normal force reading, horizontal shear force reading, and vertical shear force reading to provide a or several "mooring status reading(s)"

(d) means to control each mooring robot responsive to said mooring status reading (s) in a manner such that when any one or more of normal force reading, horizontal shear force reading reaches a predefined limit, and vertical shear force reading in a direction tending to allowing a relative movement between said vessel and said attractive force attachment element of a said mooring robot, of the holding capacity of said attractive force attachment element in such direction, said means to control initiates at least one or more selected from the following:

i. said means to establish said attractive force in a manner to increase said attractive force, ii. an alarm, and iii. a displacement of the attractive force attachment element of at least one other mooring robot relative to its base structure, in a direction opposite to the direction tending to allowing a relative movement between said vessel and said attractive force attachment element of said mooring robot, to increase the loading force on said at least one other mooring robot and reducing the loading force on the said mooring robot in said direction tending to allowing a relative movement between said vessel and said attractive force attachment element of said mooring robot.

Preferably said attractive force attachment element is a vacuum pad or cup and said means to establish the attractive force between said vessel and said attractive force attachment element is a vacuum system in fluid communication with said vacuum cup and includes a vacuum generator (preferably a vacuum pump).

Preferably wherein at least two mooring robots ("bow set") are provided to be engaged proximate more to the bow of a said vessel and at least two mooring robots ("stern set") are provided to be engaged proximate more to the stern of said vessel, wherein said means to control can control the attractive force of each attractive force attachment element and in a manner wherein when the attractive forces applied to the vessel surface by at least one of said mooring robot of each set reaches a first threshold the means to control operates in a manner to normalise the attractive force of each robot of each set.

Accordingly in a further aspect the invention comprises a vessel mooring system which includes at least two mooring robots secured to a terminal, the terminal being either a fixed or floating dock (or a second vessel) each mooring robot including an attractive force attachment element engaged to a base structure of said mooring robot said base structure fixed relative to the terminal, said attractive force attachment element to be releasably engaged with a vertically extending port or starboard side disposed vessel surface for making fast the vessel to said terminal, said attractive force attachment element capable of exerting an attractive force normal to said vessel surface at where it is to be attached, means to establish the attractive force between said vessel and said attractive force attachment element wherein for each robot, said system further including (a) means to measure the attractive force between the attractive force attachment element and the vessel to provide an "attractive force capacity reading" and (b) means to measure the force between said attractive force attachment element and the fixed structure of said mooring robot at least in a direction parallel to the said normal to provide a "normal force reading"

(c) means to monitor the relationship between said attractive force capacity reading and said normal force reading to provide a "mooring status reading"

(d) means to control the mooring robot responsive to said mooring status reading in a manner such that when the normal force reading in a direction tending to separate the attractive force attachment element from said vessel reaches an attractive force reading threshold, said means to control initiates at least any one or both of selected from the following:

i. said means to establish said attractive force in a manner to increase said attractive force, and ii. an alarm.

Preferably wherein each mooring robot includes means to actuate translational movement of the attractive force attachment element relative to the base structure in at least an athwartship direction and wherein said means to control may in addition initiate a displacement of attractive force attachment element of an other robot of said system in the athwartship direction towards its said fixed structure thereby increasing the loading force of said other of said mooring robots dependent on such an other mooring robot having capacity determined from said attractive force capacity reading, to do so.

Preferably said system further includes a. means to determine shear force holding capacity between said attractive force attachment element and said vessel resultant from said attractive force capacity reading, in a horizontal direction and perpendicular to said normal, to provide a "shear force holding capacity reading"

b. means to measure the shear direction force, being a force parallel to said shear holding force, between said attractive force attachment element and said fixed structure of said mooring robot to provide a "shear force reading"

c. means to monitor the relationship between said shear force capacity reading and said shear force reading to provide a "second mooring status reading"

wherein said means to control the mooring robot is also responsive to said second mooring status reading in a manner such that when the shear force reading in a direction tending to allowing relative movement of said vessel and said attractive force attachment element, reaches a predetermined limit, said means to control initiates at least one or more selected from the following:

i. said means to establish said attractive force in a manner to increase said attractive force, and ii. an alarm.

Preferably said means to actuate translational movement of the attractive force attachment element is a linear actuator having an operation axis in the athwartship direction.

Preferably said means to actuate translational movement of the attractive force attachment element is a hydraulic linear actuator having an operation axis in the athwartship direction, said normal force measurement derived from a means to sense the hydraulic pressure of said hydraulic linear actuator.

Accordingly in still a further aspect the invention comprises a vessel mooring system for controlling the mooring of a vessel with a wharf facility said system comprising:

at least one mooring robot for releasably fastening to said vessel said mooring robot including i. a fixed structure fastened to said wharf facility, ii. an attractive force attachment element for releasable engagement with a planar vertical surface of vessel, said attractive force attachment element moveably disposed from said fixed structure to allow its relative movement to said facility in 3 orthogonal directions being a vertical direction, a first horizontal direction parallel to the normal of the vertical surface and a second horizontal direction parallel to the planar vertical surface iii. means to actuate movement of the attractive force attachment element in at least said first and second horizontal direction means to generate a force signal representative of the force between the fixed structure and said attractive force attachment element in a direction parallel to said first horizontal direction, and means to generate a force signal representative of the force between the fixed structure and said attractive force attachment element in a direction parallel to said second horizontal direction means to generate a force signal representative of the tensile holding force between said attractive force attachment element and said vessel in said first horizontal direction, means to determine the shear holding force between said attractive force attachment element and said vessel in said second horizontal direction means responsive to said first and second and third mentioned means to generate a force signal, which when one or more of (a) the force measured by said first mentioned means to generate a force signal reaches a predefined value approaching the tensile holding force and (b) the force measured by said second mentioned means to generate a force signal reaches a predefined value approaching the shear holding force initiates any one or more selected from the following;

(a) an alarm and (b) an increase in the attractive force of said attractive force attachment element with said vessel and (c) the actuation means to change in the acceleration/deceleration of said attractive force attachment element relative to said wharf facility in a direction to reduce that force which is over said predefined value being one or both of:

i. the force between the fixed structure and said attractive attachment element in a direction parallel to said second horizontal direction and/or ii. the force between the fixed structure and said attractive attachment element in a direction parallel to said first horizontal direction.

Accordingly in still a further aspect the invention comprises a mooring system for releasably affixing a vessel floating at the surface of a body of water to a terminal which is secured to the bottom of said body of water wherein said vessel is subjected to loading forces resultant from any one or more of wind, tides, water currents, waves, vessel loading levels, and movement actuated by said system, said system including at least one mooring robot which includes a) a base structure affixed to one of said terminal or said vessel, b) an attractive force attachment element engaged to said base structure, said attractive force attachment element adapted to become affixed to and establish an attachment with a surface of the other of said one of said terminal or vessel, said attachment being of an attractive kind establishing an attractive holding force normal to the surface at which it is to attach, means to determine the attractive holding force of said attractive force attachment element when said attractive force attachment element is in an attached relationship with said surface means to determine the shear direction holding force of said attractive force attachment element with said surface when said attractive force attachment element is in an attached relationship with said surface, said shear direction holding force (herein after "horizontal shear direction holding force") being in a horizontal direction and perpendicular to said normal, means to determine at least one or more selected from the group consisting of a. the force (herein after "tensile force") applied by said surface to said attractive force attachment element in a direction parallel to said normal, and b. the force (herein after "horizontal shear force") applied by said surface to said attractive force attachment element in a horizontal direction and perpendicular to said normal, and means for allowing comparison between i) said the attractive holding force and said tensile force and ii) said the horizontal shear direction holding force and said horizontal shear force.

Preferably said means for allowing comparison will initiate, when one or both of i. said tensile force reaches a predetermined limit being a limit below the attractive holding force but approaching said attractive holding force in a direction to tend towards the release of said attractive force attachment element with said surface, and ii. said horizontal shear force reaches a predetermined limit being a limit below the horizontal shear direction holding force but approaching said horizontal shear direction holding force in a direction to tend towards a relative movement in a horizontal direction between said surface and said attractive force attachment element, one or more selected from i. means to establish and vary said attractive force, in a manner to increase said attractive holding force, and ii. an alarm.

Preferably said means to determine the attractive holding of said attractive force attachment element when said variable attractive force attachment element is in an attached relationship with said surface includes a sensor responsive to force between said attractive force attachment element and said surface in a direction normal to said surface and a means responsive to the signal from said sensor to determine the effective attractive holding force.

Preferably said attractive force attachment element is movably engaged to said base structure by a linkage mechanism and there is provided means to actively actuate the movement of said variable attractive force attachment element relative to said base structure parallel to said horizontal shear force direction and parallel to said tensile force direction.

Preferably said attractive force attachment element is movably engaged to said base structure by a linkage mechanism and there is provided means to actively actuate the movement of said variable attractive force attachment element relative to said base structure parallel to said horizontal shear force direction and means to actively actuate the movement parallel to said tensile force direction wherein said means for allowing comparison may further initiate, when one or both of i. said tensile force reaches a predetermined limit being a limit below the attractive holding force but approaching said attractive holding force in a direction to tend towards the release of said attractive force attachment element with said surface, and ii. said horizontal shear force reaches a predetermined limit being a limit below the horizontal shear direction holding force but approaching said horizontal shear direction holding force in a direction to tend towards a relative movement in a horizontal direction between said surface and said attractive force attachment element, a change in velocity (acceleration or deceleration) of said attractive force attachment element by one or both of said means to actively actuate the movement in order for said tensile force and/or horizontal shear force to remain below their respective limits.

Preferably said attractive force attachment is a variable attractive force attachment element wherein its attractive force may be varied by the means to control the attractive force.

Preferably said attractive force attachment element is a vacuum cup defining a pressure controllable cavity when engaged with said surface and wherein said means to control the attractive force includes a vacuum inducing means which is in fluid communication with said cavity to control the pressure in said cavity.

Preferably said means to determine the shear direction holding force of said attractive force attachment element with said surface when said attractive force attachment element is in an attached relationship with said surface also determines the shear direction holding force (herein after "vertical shear direction holding force") in a vertical direction and perpendicular to said normal and wherein a means to measure the force (herein after "vertical shear force") applied by said surface to said attractive force attachment element in a vertical direction and perpendicular to said normal is provided, for the purposes of comparison of said vertical shear direction holding force with said vertical shear force.

Preferably said means for allowing comparison will also initiate, when said vertical shear force reaches a predetermined limit being a limit below the vertical shear direction holding force but approaching said vertical shear direction holding force in a direction to tend towards a relative movement in a vertical direction between said surface and said attractive force attachment element, one or more selected from i. means to establish and vary said attractive force, in a manner to increase said attractive holding force, and ii. an alarm.

Preferably said means to determine the horizontal shear force and/or tensile force includes means to measure responsive to such force(s) and means to read said means to measure said means to read providing a signal useable by said means allowing comparison.

Preferably said means to determine the attractive holding force includes means to measure responsive to such force and means to read said means to measure said means to read providing a signal useable by said means allowing comparison.

Preferably said attractive force attachment element is a vacuum cup defining a pressure controllable cavity when engaged with said surface and wherein said means to control the attractive force includes a vacuum inducing means which is in fluid communication with said cavity to control the pressure in said cavity, said means to measure responsive to said attractive force being a pressure transducer engaged with said mooring robot in manner to measure the pressure differential between the cavity of said vacuum cup and ambient atmospheric pressure.

Preferably said means to measure the said horizontal shear direction holding force means is means to calculate such horizontal shear direction holding force from said measured attractive holding force.

Preferably wherein means to calculate includes a table of empirically collected attractive holding force varying and dependent horizontal shear direction holding force reflective numbers reliant on which said horizontal shear direction holding force can be determined.

Preferably said means to actively actuate includes at least one hydraulic ram.

Preferably wherein means to measure the displacement of said attractive force attachment element relative to said base structure is provided.

Preferably wherein an alarm is sounded when one of more of the limit of movement of said attractive force attachment element relative to said base structure is reached.

Preferably wherein the displacement of said attractive force attachment element relative to said base structure is visually represented.

Preferably said attractive forces is able to be controlled by human input.

Preferably said displacement is able to be controlled by human input.

Preferably the vacuum cups are likewise displaceable relative to the base structure in a horizontal and perpendicular direction to the normal and a control over the horizontal shear force can be had by the acceleration/deceleration of the vacuum cup in the horizontal direction by means to actively actuate the movement of the cups in the horizontal direction.

The means which may actively actuate the horizontal direction of movement if said cup relative to said base structure is preferably a hydraulic ram wherein the cup is mounted from said fixed structure by a translational movement allowing connection.

Preferably said means to measure said tensile and/or shear force includes a pressure transducer directly responsive to a respective hydraulic ram operating the control of the position of said vacuum cups in the direction of measurement by said pressure transducer being coupled to the hydraulic pressure of said hydraulic ram.

Preferably said second mentioned hydraulic ram has an operational axis of movement which is horizontal and transverse to the direction of said normal.

Preferably said means to measure said shear force includes a pressure transducer directly responsive to the hydraulic pressure of said hydraulic ram.

Controlling the operation of a mooring system according to the method of certain embodiments improves its performance, reduces energy consumption and improves safety. By providing an alarm as capacity is approached, together with feedback of the capacity and the magnitude and direction of the applied loads, it allows the master of the vessel to take the most appropriate action to ensure the safety of the vessel in extreme conditions.

Where reference herein is made to a "direction" parallel to the direction ending to cause relative movement or separation, it is to be considered as being movement or measurement as appropriate in either generally the same direction or opposite direction.

BRIEF DESCRIPTION OF DRAWINGS

Further aspects of the present invention win become apparent from the following description which is given by way of example only and with reference to the accompanying drawings in which:

FIG. 7 illustrates a force diagram in perspective, of the forces which may be applied and measured to the mooring robot of a kind as shown in FIG. 2;

FIG. 8 is an end view of FIG. 7;

FIG. 9 is a side view of FIG. 7;

FIG. 10 is a plan view of FIG. 7;

FIG. 11 is a perspective view of a force diagram showing three orthogonal axes in which forces may be measured in a mooring robot as for example shown in FIG. 2;

FIG. 12 is an end view of FIG. 11;

FIG. 13 is a side view of FIG. 11;

FIG. 14 is a plan view of FIG. 11;

FIG. 15 is a perspective view of a force diagram of a mooring robot of a kind as shown in FIG. 2 and to illustrate that the geometry of the arrangement may be such as to not provide a direct measurement of force in the desired axis;

FIG. 16 is an end view of FIG. 15;

FIG. 17 is a side view of FIG. 15;

FIG. 18 is a plan view of FIG. 15;

FIG. 40 is a side view of a mooring robot of the present invention illustrating the degree of freedom of movement of the vacuum pads relative to the fixed structure of the mooring robot about a Z axis direction;

FIG. 41 is a side view of a mooring robot of the present invention illustrating the degree of freedom of movement of the vacuum pads relative to the fixed structure of the mooring robot about a Y axis direction; and FIG. 42 is a side view of a mooring robot of the present invention illustrating the degree of freedom of movement of the vacuum pads relative to the fixed structure of the mooring robot about a X axis direction.

DETAILED DESCRIPTION OF THE INVENTION

Figure 1:
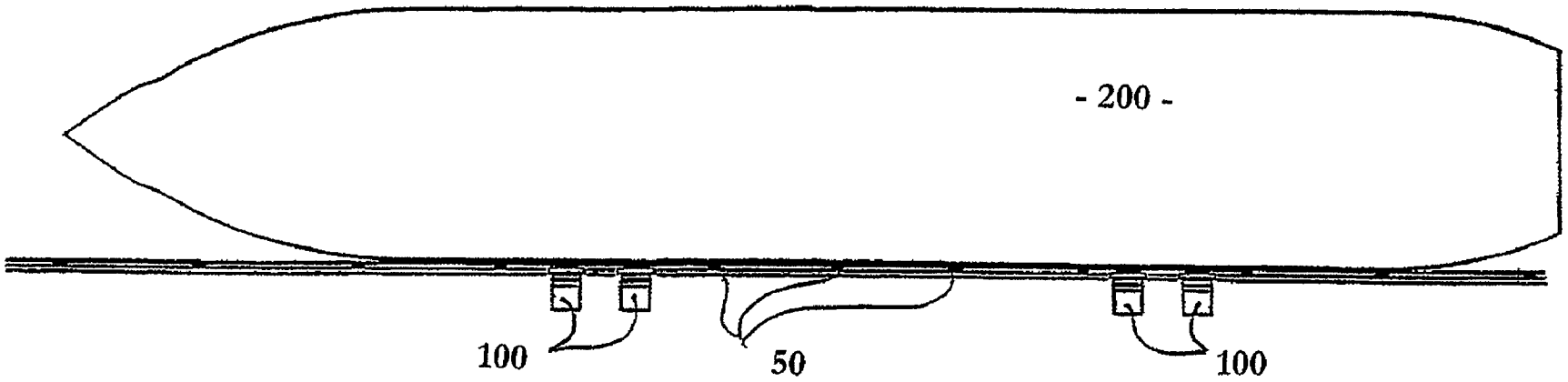
FIG. 1 is a plan view illustrating a plurality of mooring robots holding a vessel in an engaged condition to a wharf.
Figure 2:
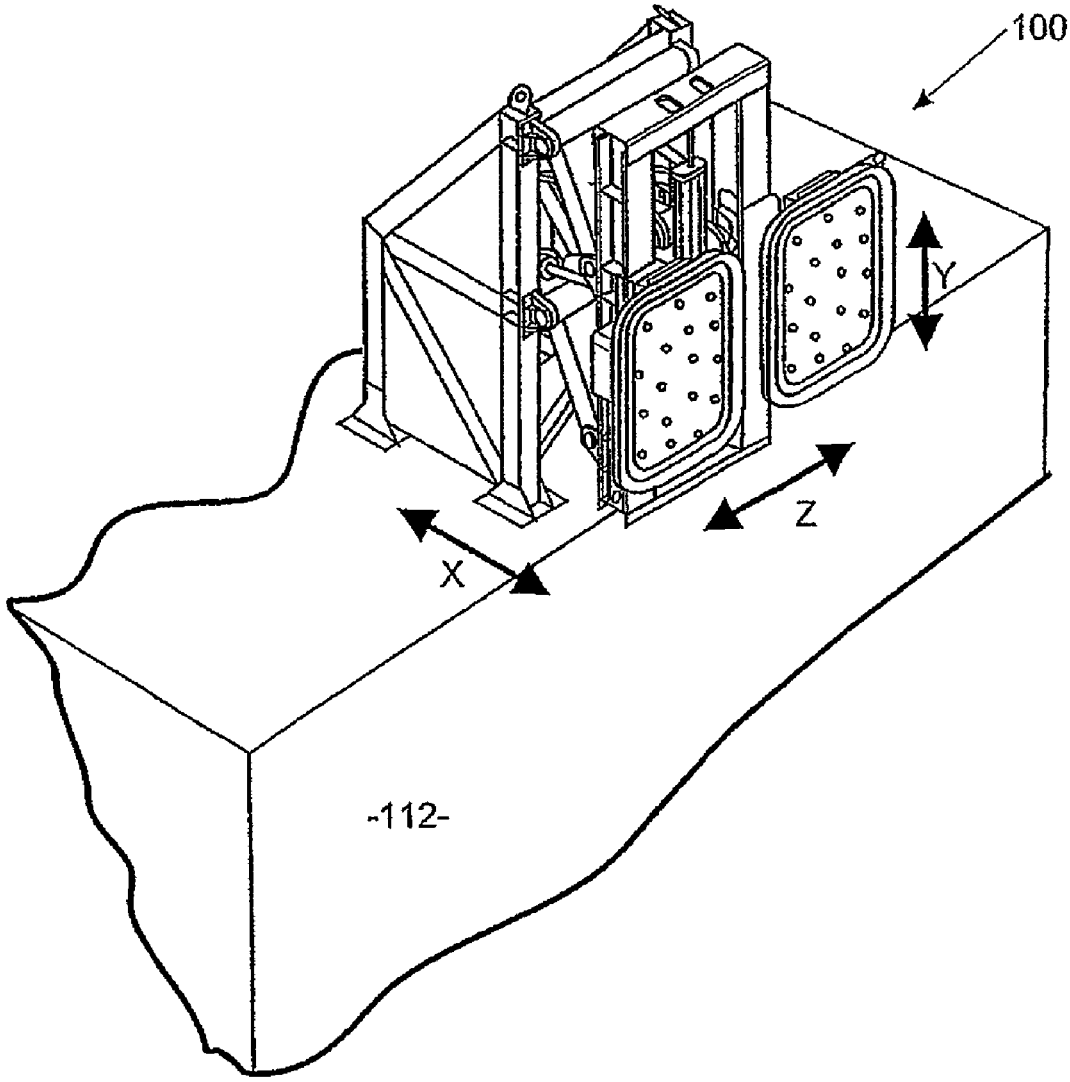
FIG. 2 is a perspective view of a mooring robot engaged to a wharf illustrating the vacuum pads in a condition ready for being received against a hull of a vessel and wherein for subsequent reference herein, the axes of movement of the vacuum pads relative to the wharf are illustrated.
Figure 3:
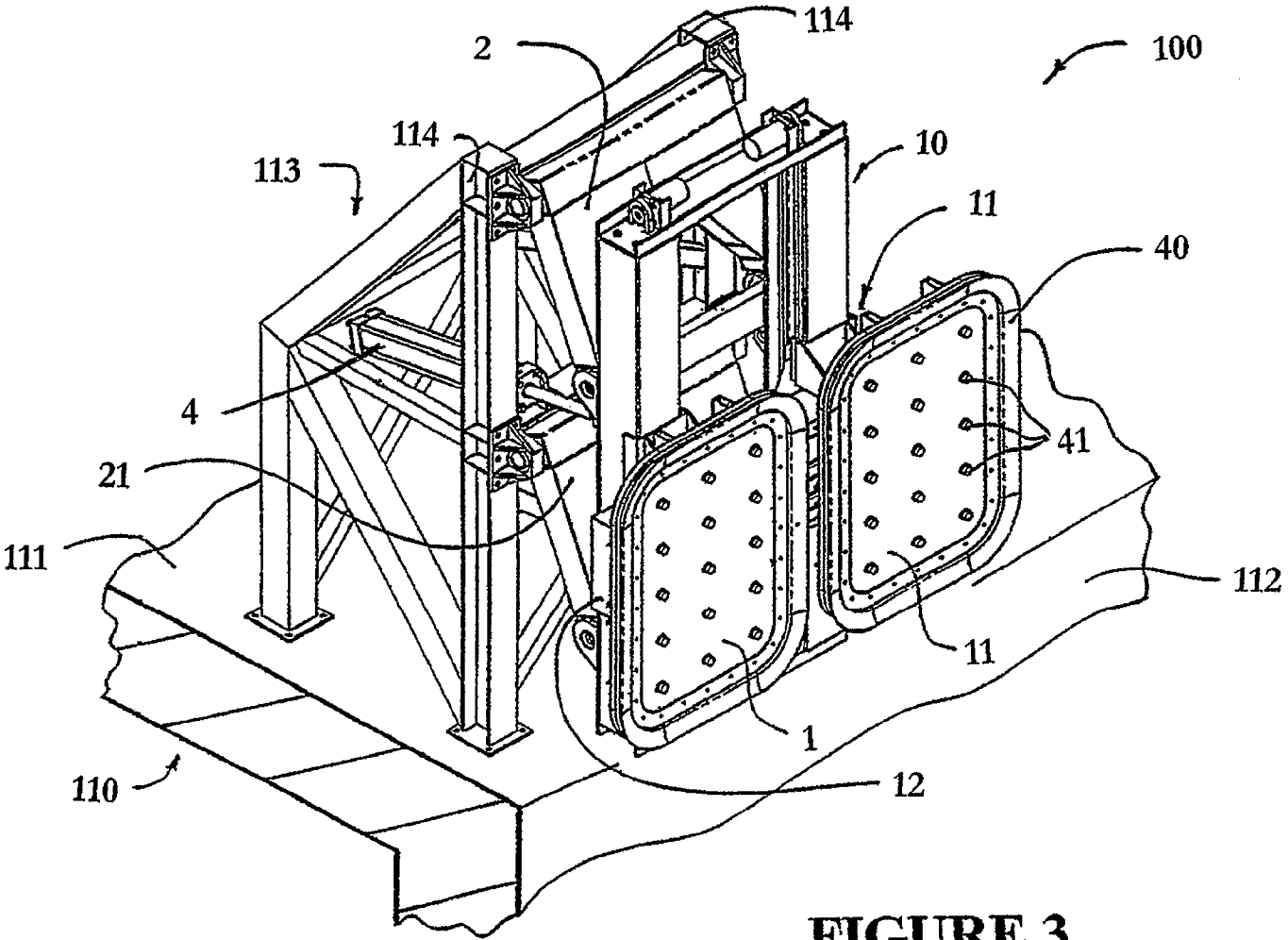
FIG. 3 is a pictorial view of a preferred embodiment of a mooring robot for the system and performing the method of the present invention.

Referring to FIGS. 1, 2 and 3 of the drawings, the present invention comprises a mooring system incorporating at least one and in a more preferred form, a plurality of mooring robots 100, which may be of a kind described in our PCT International Application No. PCT/NZ02/00062. The description of the mooring robots in PCT/NZ02/00062 is hereby incorporated by reference. Other preferred embodiments of a mooring robot for the system of the present invention may also be utilised and reference will hereinafter be made to an alternative form with reference to FIGS. 19 to 21. The mooring system may alternatively include mooring robots 100 fixed to the vessel allowing the vessel to be readily fastened to a bearing plate fixed to the dock 110 or to another vessel. Whilst reference in the most preferred form of the invention is made to a configuration where a mooring robots is fixed on a wharf, it will be appreciated that such mooring robots may alternatively be engaged to fixed pylons or for the purposes of ship to ship mooring.

With reference to FIG. 1 a plurality of mooring robots 100 are mounted to a wharf or dock 110. The wharf or dock is at terminal or base with which it is desired for the ship to moor, usually for the purposes of loading and unloading of cargo.

The robots may for example be fixed to a front mooring face 112 and/or deck 11 of the dock. The mooring robot 100 of FIG. 3 preferably includes at least one or one pair of vacuum cups or pads 1, 1' which are maintained substantially parallel to the plane of the front mooring face 112 for engagement with the hull of a vessel. In the most convenient form, the cups are to engage with vertically extending planar surfaces of a ship such as a port or starboard side hull surface. In one embodiment cups selectively provide an attractive force between the fixed structure of the robot and the surface with which it is to engage (eg the hull of the ship).

The mooring robot 100 is capable of positioning the vacuum cups 1, 1' in three dimensions, referred to herein as "vertical", "longitudinal" and "athwartship", also corresponding to axes Y, Z, X respectively. "Longitudinal" refers to a direction generally perpendicular to the vertical axis and parallel to the longitudinal axis of the moored vessel or the front mooring face 112 of the dock.

Variations from axes X, Y and Z being perpendicular to each other are anticipated by the inventors and accordingly where such (but less desirable) non perpendicular components of direction are to be measured, the system of the present invention can be tailored to accommodate such deviations.

Whilst the mooring robot used for the mooring system may permanently hold the vacuum cups in a fixed position, in the preferred form the cups can be moved relative to the fixed structure to thereby allow movement of the vessel when the cups are in an engaged condition. For such purposes, the mooring robot of FIG. 3 includes a parallel arm linkage for movement of the vacuum cups 1, 1' in the athwartship direction. It includes parallel upper and lower arms 2, 2' connected between a pair of columns 114 of the framework 113 and a vertical guide 10. The arms 2, 2' are fixed to the framework 113 to allow for pivoting movement about respective longitudinally and horizontally extending axes wherein each arm 2, 2' is fixed in bearings 3 fastened to the columns 114. Likewise, a pivoting connection is provided between the arms 2, 2' and the guide assembly 10. Actuation of movement of the vacuum cups in the athwartship direction is provided by a hydraulic ram 4 or rams, which is also pivotably connected between the framework 113 and the guide 10.

A carriage 11 engages with the vertical guide 10 to control vertical movement. The guide 10 is an assembly including a pair of parallel elongate guide members 5, 5' connected by cross members 6, 7 and 8. Fixed to the top cross member 6 are two hydraulic motors 9, 9' which are each connected to a loop of chain 20 which extends parallel to each of the guide members 5, 5' and is connected to the carriage 11 for power actuated raising and lowering thereof.

As an alternative to hydraulic motors, hydraulic rams may be used. The rams are each connected to a loop of chain for actuating the displacement thereof appropriately.

A sub-frame 12 to which the vacuum cups 1, 1' are mounted is slidably engaged with the carriage 11 for longitudinal direction movement of the vacuum cups 1, 1'. The carriage 11 includes vertical channels 21, 21' for engagement with the guide members 5, 5' and a longitudinally extending track 22 in which the sub-frame 11 is slidingly received. Longitudinal direction movement of the vacuum cups 1, 1' is actuated by hydraulic ram 23 fixed in the track 22, the ram 23 being a double-acting type with a continuous piston rod 24 extending from both ends of the cylinder 23.

Each mooring robot 100 also includes a hydraulic power source preferably mounted inside the framework 113 and associated controls.

A vacuum pump provides means for drawing a vacuum in the vacuum cups 1, 1'. Whilst reference is herein made to a vacuum and vacuum pump, such is to be considered as being of a kind where perhaps not a full vacuum is being provided but wherein a pressure differential between normal atmospheric conditions and the pressure within the enclosure defined between the hull and the vacuum cups is of a nature to establish a holding force between the vacuum cups and the hull. It may accordingly not be strictly speaking a vacuum that is being provided but is of such a pressure differential to ambient atmospheric pressure, sufficient for a holding force to be established by suction of the vacuum cups against the vessel.

Details of the hydraulic and pneumatic vacuum system and its related control will hereinafter be described.

The mooring robot of FIG. 3 allows for the positioning of the vacuum cups to be controlled both in the vertical, longitudinal and athwartship directions. Actuation of the hydraulic rams (or other means of actuation) to achieve such positioning in those directions will allow for the positioning of the vacuum pads to be adjusted to the desired position.

Referring to FIG. 1, to make fast a ship, the vacuum cups 1, 1' are extended from the front mooring face 112 when a vessel 200 approaches. The cups are pre-positioned to engage with a planar section of the ship. In the most preferred form the planar portion is part of the hull of the ship. It is however anticipated that the vacuum cups may also be adapted for engagement to a non planar section of a hull. Furthermore whilst and in the most preferred form the vacuum cups attach to a hull section of the vessel, it is envisaged that alternative location points may also be provided for attachment of the vacuum cups with the vessel. Part of the superstructure may provide a surface for engagement by the vacuum cups of a mooring robot.

Figure 38:
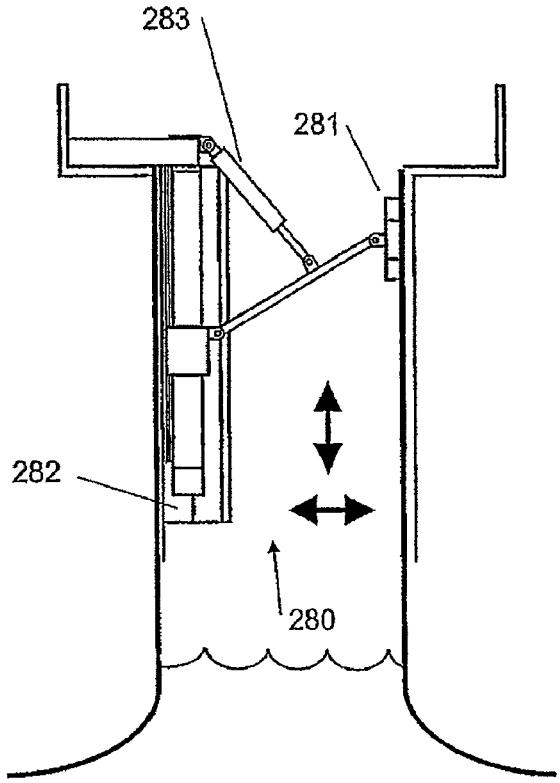
FIG. 38 is an end view of two adjacent vessels illustrating an alternative configuration of mooring the two vessels together by the use of a mooring robot of the present invention.
Figure 39:
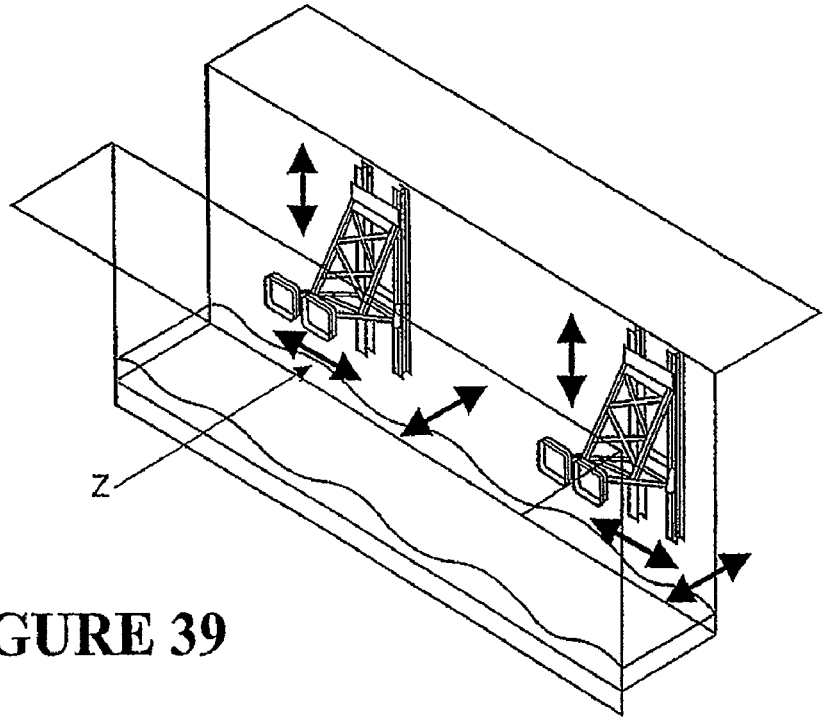
FIG. 39 is a perspective view of the mooring robot which may be utilised as for example shown in FIG. 38.

Whilst in the most preferred form the invention has been described where the mooring robots are affixed to the shore and the vacuum pads become affixed to the vessel, a vice versa arrangement may be provided where the mooring robots form part of the vessel and the vacuum pads engage against a surface affixed to the wharf. As a further alternative within the scope of the present invention, a mooring robot may be engaged to a vessel and be adapted for engaging to an adjacent vessel to establish a ship to ship mooring relationship. Such is for example shown in FIGS. 38 and 39. FIGS. 38 and 39 illustrate such an alternative configurations of mooring robots which may be utilised in particular although not solely for the purposes of mooring two vessels together. The mooring robot 280 may present a vacuum cup 281 from a fixed structure side 282 of the mooring robot 280 which remains affixed to vessel A. A hydraulic ram 283 may provide the source of force measurement in the athwartship direction. The structure/hydraulics and geometry allows for the vessel to move/rotate relative to each other in all directions and within the range of the system. With reference to FIG. 39, longitudinal movement in direction Z is also catered for.

Once contact is made with the cups against the ship, the vacuum cups 1, 1' are evacuated in order to fasten to the ship. A pneumatic system is provided and includes a vacuum pump which may be activated until a differential pressure of a certain threshold (e.g. of 80%) to the ambient atmospheric pressure is obtained in the vacuum cups. An appropriate level of vacuum is achieved before actuating the mooring robot 100 to move the ship 200 to the desired moored position. Whilst a vacuum pump is the most preferred form of establishing a vacuum in the vacuum cups, alternative means of establishing a vacuum may be utilised such as a for example a venturi system.

After or before the desired moored position is reached the vacuum pump may be stopped and a vacuum accumulator (not shown) may be cut into the system including the vacuum cups 1, 1' to maintain the vacuum. Once the vacuum cups are engaged with the hull of the ship 200, the vertical control of the vacuum pads may be inactivated such that the mooring robot becomes passive in the vertical positioning of the vacuum cups, at least while the cups remain affixed to the ship. Changes in the tide or in the loading of the vessel thereby allow for the vacuum cups to free travel in a vertical direction relative to the wharf and to the fixed structure of the mooring robot. The forces to which the vessel is subjected to as a result of loading and the state of the tide are of such a large quantity that the mooring robots of the present invention could not be expected to react against such in the vertical direction. Accordingly a free floating condition in a vertical direction of the vacuum cups is established once the vacuum cups are engaged to the hull.

Some degree of passive movement of the vacuum pads relative to the fixed structure of the mooring robot may also be provided in rotational axes parallel to the X, Y and Z directions. Differential loading between the port and starboard side of a vessel may cause rotation of the hull surface about the Z axis. Similarly differential fore and aft loading may cause rotation of the hull about the X axis. Accordingly a yoke like connection of the vacuum pads with the fixed structure of the mooring robot may be provided.

FIG. 40 shows that the vacuum pads may be mounted relative to the fixed structure of the mooring robot to allow for rotation of the vacuum pads about the Z axis. Such is to allow for variation in the list and heel of the ship.

FIG. 41 shows that the vacuum pads may be mounted relative to the fixed structure of the mooring robot to allow for rotation of the vacuum pads about the Y axis. Such is to allow for variation in the yaw and misalignment of the ship.

FIG. 42 shows that the vacuum pads may be mounted relative to the fixed structure of the mooring robot to allow for rotation of the vacuum pads about the X axis. Such is to allow for variation in the changes in the ship trim.

Individual pad rotations may be affected through the use of plain spherical bearings 540 acting as universal joints at the back of each vacuum cup. The pair of pads 541 and 542 are each connected to the swing beam 543 which is connected via a swing beam pin 544 to the carriage arrangement 545 of the mooring robot.

Once engaged to the ship, control of the robot occurs. Such may in one respect be control over the positioning of the vacuum cups in a longitudinal and athwart direction relative to the fixed structure of the mooring robot such is preferably maintained by the hydraulic rams to thereby control the position of the ship in these directions.

The system preferably operates such that each mooring robot 100 maintains the ship, within certain limits of displacement, in a moored condition in response to changing loading conditions resultant from wind, tidal flow and/or swell. On attaining the desired moored position the hydraulic pump powering the rams may be stopped and an accumulator may be cut into the hydraulic lines to the rams 4 and 24, thus providing a resistive resilient passive mode of operation of the rams. When displacement from the desired predefined moored position by longitudinally or athwartship external forces occurs, the accumulator is passively pressurised increasing the hydraulic pressure and hence resistive force to the rams 4, 23 tending to restore the ship to the desired moored position. Positioning can be determined from position indicator means, part of the robot to which further reference will herein after be made.

Active pressurisation of the rams is preferably also controlled for purposes of repositioning and/or load distribution. Reference will be made to such hereinafter.

Whilst in one preferred form the vacuum or hydraulic pumps are cut out of the system when the accumulators are cut in, it is envisaged that the pumps may remain connected to the system simultaneously to the system being cut in with the accumulators. One reason however for cutting out the pumps is to reduce the leakage rate.

The most critical forces to which the ship is subjected are those caused by current or wind that have a component in the athwartship direction acting to separate or cause relative sliding movements between the vessel 200 from the robots 100.

The forces to which the ship may be subjected as a result of current and/or wind which act on the ship in the athwartship direction may act to move the ship away from the wharf tending towards separation of the cups with the ship. Such a tensile loading between the ship and the wharf is taken up by the mooring robot. Such tensile loading acts to move the ship in a direction which may ultimately lead to a popping off of the ship from the vacuum cups. Similarly the longitudinal movement may result in a slipping of the cups long the hull of the ship. The importance of maintaining a fixed relationship between the vacuum cups and the vessel in the longitudinal direction is therefore also high. In particular it is important to know the forces applied to the vacuum cup by such loading in directions parallel to the suction force for popping off reasons and perpendicular thereto for slippage reasons. In the most preferred form the vacuum cups are engaged to a vertical surface of the ship. This results in a horizontal suction force perpendicular to the longitudinal direction and vertical direction. Reference to the longitudinal direction holding force (a shear force as opposed to a tensile force) will hereinafter be made. Reference will firstly be made to the athwartship loading that the vessel may apply to the mooring robot, in particular in the direction to encourage the tensile direction separation of the vessel with the mooring robot.

The athwartship force induces a tensile force between the vacuum cups and the vessel. In order to allow for the appropriate level of vacuum to be applied by the vacuum cups to secure the ship to the mooring robot it is important to know the loads that are being applied by the ship to the mooring robot.

Figure 36:
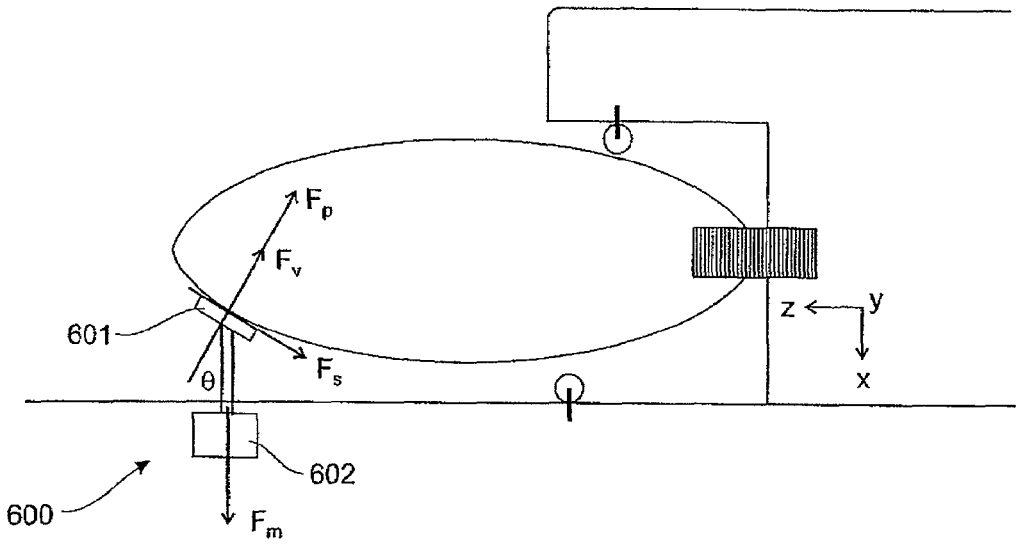
FIG. 36 is a plan view of a mooring system wherein the forces which are measured at a mooring robot may not be parallel to the forces which are applied by the ship to the vacuum pad or pads of the mooring robot.

Firstly it is important to recognise, with reference to FIG. 36 which is a plan view of a ship adjacent a wharf, that a mooring robot 600 may present the vacuum cups 601 where the suction force normal to the surface of the vessel where the vacuum cup 601 is engaged, is not parallel the athwartship direction and may hence not be parallel to the force measured Fm between the vacuum cup 601 and the fixed structure 602 of the mooring robot. However since it is important to know the force between the mooring robot and the vessel in a direction parallel to the normal, for the purposes of determining whether the holding capacity in this direction is being reached, it will be necessary to conduct further calculations to convert the force measured Fm to the actual pull force Fp to which the vacuum cup 601 is being subjected to by the ship. The angle θ may need to be measured for the purposes of converting the force Fm to the force Fp. FIG. 36 illustrates a non alignment of the force Fp with the force Fm in a plan view however alternatively or in addition, a variation of angle, not just about the Y axis but instead or in addition about the Z axis may also need to be taken into consideration. This is particularly so for ships where the surface with which the vacuum cups are to engage are not presented substantially vertically and/or parallel to the longitudinal edge of a wharf.

The vacuum cups may be operated over a large range of vacuum in order to maintain a connection with the vessel. Indeed where the wind or tidal force applied against the ship in a direction such that the ship is pushed against the vacuum cups, theoretically, no vacuum needs to be provided. However under tensile loading (opposite to the compressive loading) vacuum needs to be applied to the vacuum cups in order to ensure that a connection is maintained between the ship and the mooring robots. However such vacuum need not be provided at the maximum vacuum possible to provide the maximum holding force between the vacuum cups and the vessel. By monitoring the force that is applied by the vessel to the mooring robot the system may in one aspect exercise a control over the vacuum cup vacuum in order for such to be maintained to a suitable level sufficient to maintain a mooring connection. Where the tensile loading applied by the vessel to the mooring robot exceeds a certain threshold, the vacuum system may be operated to increase the vacuum that is provided to the vacuum cups to thereby increase the holding strength of the vacuum cups with the vessel. For example in a normal operating condition the vacuum may be maintained at somewhere between 60 to 80%. As a result of an increase in tensile load applied by the vessel to the cups as measured between the cups and the fixed structure of the mooring robot, as soon as such force reaches a predetermined limit, the vacuum pumps may be actuated in order to increase the vacuum and thereby the tensile force holding capacity. Conversely where the tensile load applied by the ship to the mooring robot falls below a certain threshold (whether it is the same threshold as the threshold to activate the vacuum pumps or other) the vacuum may be reduced or the vacuum pump may be stopped. The vacuum limits may be different to thereby provide a hysteresis effect in the mooring system configuration of the pneumatic system.

Quite separately but appropriate to mention at this stage, is also the fact that the vacuum system may not be entirely leak proof. The vacuum may drop as a result of leakage to below a certain minimum threshold (such as for example 60%). As a result of a monitoring by the system of the vacuum pressure (within the enclosure defined by the cups and the vessel) the vacuum pump can be started so as to enhance the vacuum to a predetermined operating condition (such as for example between 60 and 80% vacuum). So in addition to the control of the degree of vacuum in response to the tensile loading that is applied by the ship to the mooring robot, vacuum pressure per se may be monitored and controlled by the system of the present invention.

The maintenance of the connection between the vacuum cups and the ship is also important during any instances where the repositioning of the ship occurs or is necessary. The mooring robots are preferably capable of repositioning the ship to a new location (in a longitudinal and/or athwartship displacement). The hydraulic rams of the mooring robot to position the vacuum cups athwartship and/or longitudinally can be actuated for the purposes of moving the vacuum cup(s) whilst they are engaged with the ship. Such movement will thereby result in the movement of the ship relative to the wharf. As will be appreciated a ship of a significantly large size and of a significant mass will have substantial inertial mass which has to be considered during the movement of the ship by the mooring robots. The application of force to the ship by the mooring robots for the purposes of displacing the ship will need to take into consideration such inertia particularly with a view to ensuring that during displacement the vacuum cups remain in a condition with vacuum sufficient to remain attached to the vessel. For example the application of a large force by the ram 4 in a direction to move the vessel towards the wharf will result in an increase in the tensile force between the vessel and the mooring robot particularly until such a stage that the velocity of the vessel in the direction towards the wharf is increased. The acceleration or deceleration of the ship and hence the increase in loading force may require an increase in the vacuum at the vacuum cups to thereby ensure that the cups maintain a connection with the ship. Alternatively or additionally, the acceleration or deceleration may be varied to ensure the limits of holing capacity are not breached.

Whilst reference is firstly herein be made to the athwartship forces applied by the environment or during the movement of the vessel, forces between the vessel and the cups in the longitudinal direction will also need to be consideration in a like manner and for like purposes. Accordingly where reference hereinafter is made to the athwartship forces, it is to be appreciated that such forces may be as a result of those applied to the vessel by tidal or wind loading or as a result of the movement of the vessel in the longitudinal direction by the robots.

The monitoring of the loading in at least the athwartship direction is important for the purposes of determining whether the tensile loading between the ship and the vacuum cups is going to exceed a maximum whereafter failure of the connection may occur. The monitoring of such forces to determine when a predetermined limit may be reached may then allow for an alarm to be sounded before such a limit is reached so that emergency action can be taken such as for example to secure additional fastening means to keep the ship fastened to the wharf and/or increase or redistribution of vacuum and loading forces.

Figure 4:
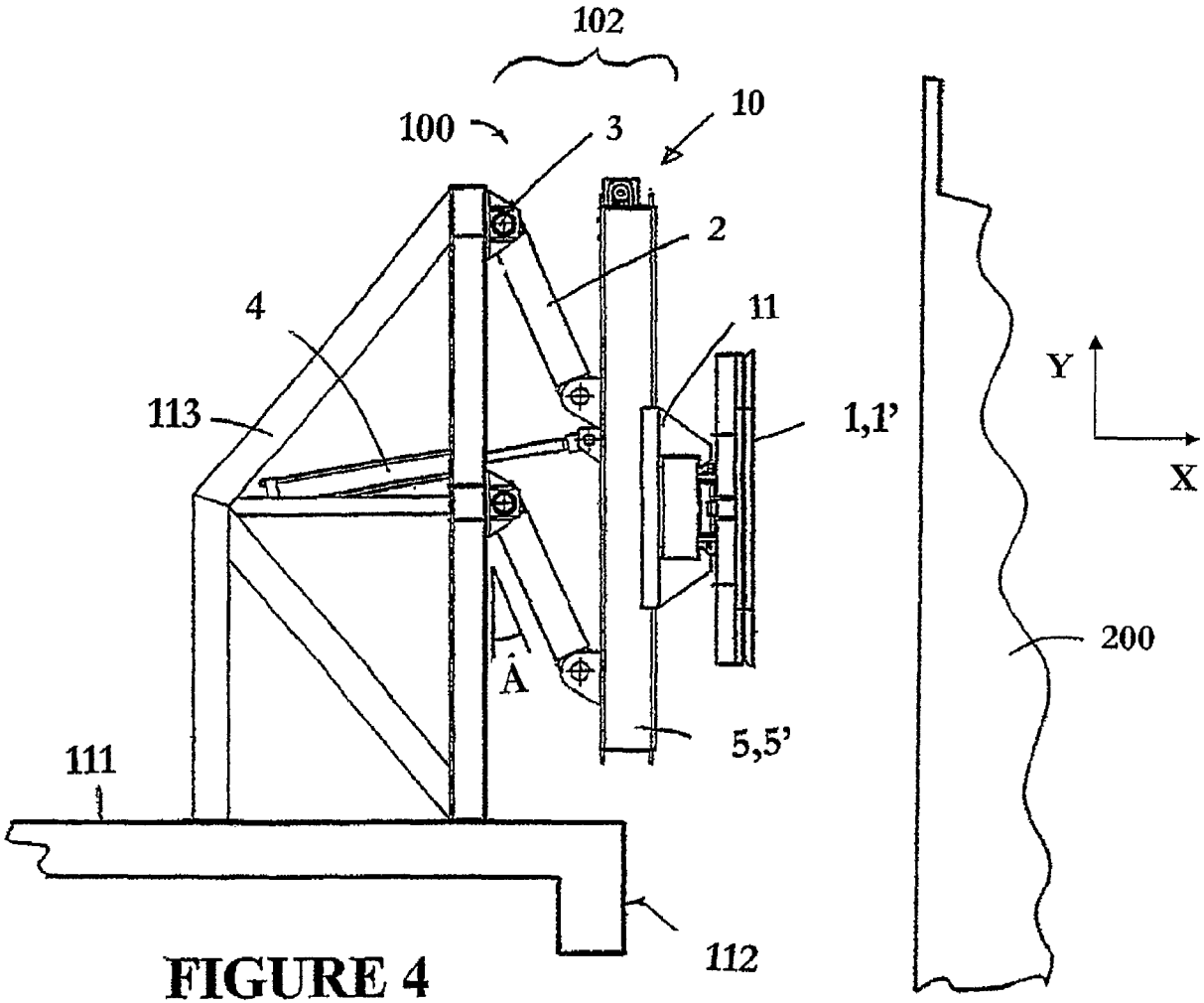
FIG. 4 is a side elevation of the mooring robot of FIG. 3.
Figure 6:
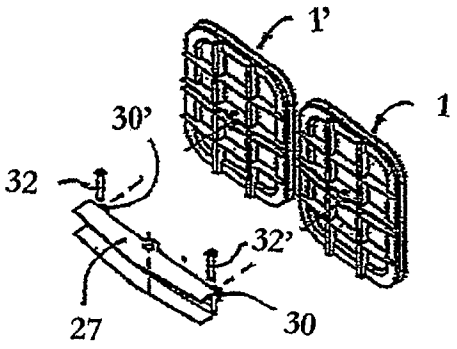
FIG. 6 shows part of the mooring robot of FIG. 5 from a rotated viewpoint.
Figure 25:
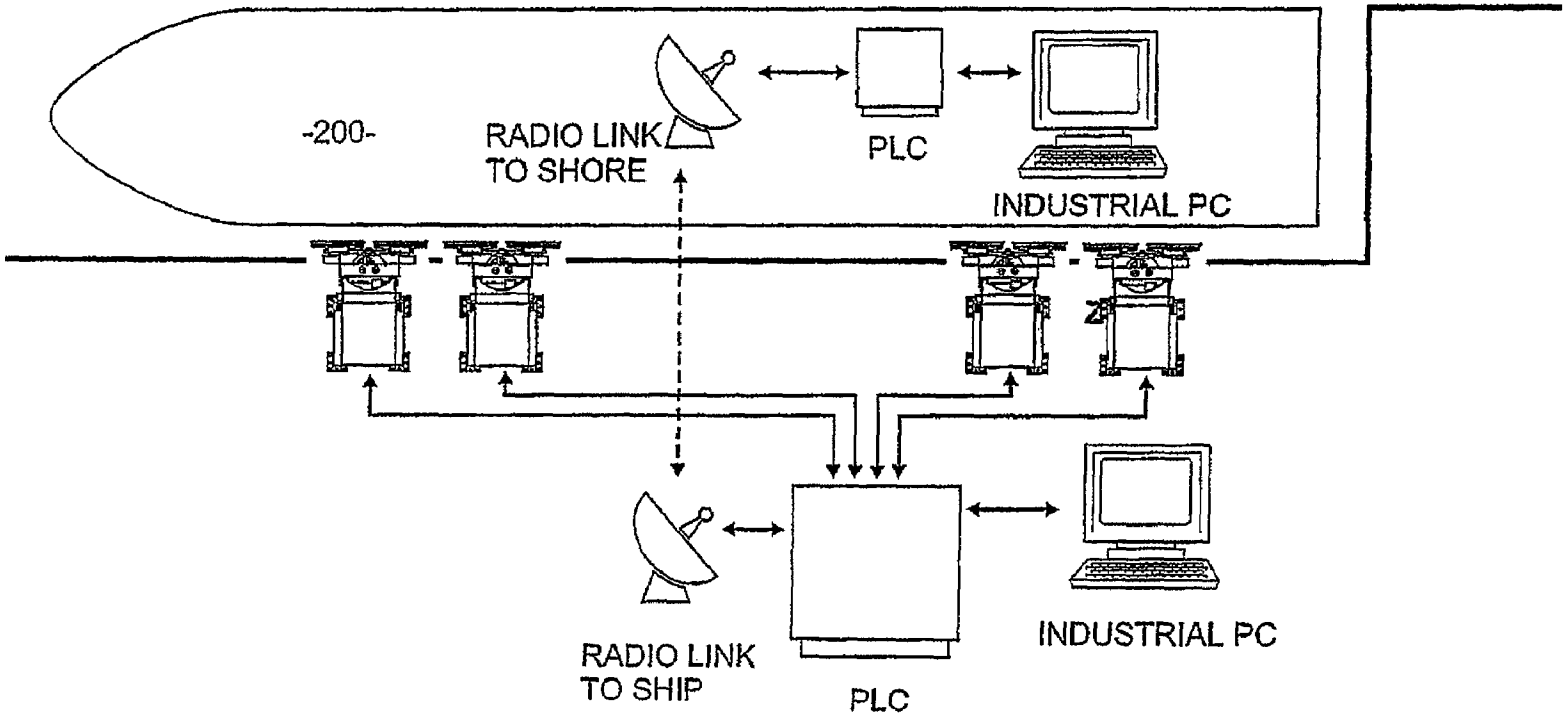
FIG. 25 is a schematic of the relationship of components of the system with the vessel and mooring robots.

As has been mentioned, reference is firstly herein made to the determination of the athwartship direction (or as with reference to FIG. 36 a force parallel to the suction pressure or pressure applied normal to the direction of the surface where the cup is engaged) of force which may be monitored by the system of the present invention. In the most preferred form and with reference to FIG. 3, the athwartship direction force between the vessel and the mooring robot is for example monitored by a pressure sensing of the hydraulic pressure in the ram 4. With reference to FIG. 25, a pressure transducer 60 is connected to the pressure line of the hydraulic cylinder or cylinders 4 which control the positioning of the vacuum cups in the athwartship direction. By the measurement of the hydraulic pressure by way of the pressure transducer 60 in the hydraulic rams 4, the force that is applied to the hydraulic rams 4 can be determined. Where the hydraulic ram actuates in a substantially horizontal direction and perpendicular to the longitudinal direction the pressure within the hydraulic line to the hydraulic cylinder 4 will be proportional to the athwartship force applied by the vessel to the mooring robot. With reference to FIG. 7 to FIG. 10 it can be seen that a hydraulic ram 4 extending in the athwartship direction has its actuation forces acting parallel to the athwartship direction X and accordingly the hydraulic pressure in the ram 4 can be directly interpolated to the force Fx provided by the vessel to the mooring robot. Where the position of the hydraulic ram 4 relative to the athwartship direction X may vary as is the case in the mooring robot of FIGS. 3 and 4, or FIG. 36, a knowledge of the angular displacement of the axis of operation of the ram 4 relative to the athwartship direction X may also need to be determined in order for the hydraulic pressure measured by the transducer 60 to be converted to a force in the athwartship direction X. With reference to FIGS. 15 to 17 it can be seen that the ram 4 may be provided in an angular displacement A to the X direction. With simple Pythagoras theorem calculus, the knowledge of the hydraulic pressure of the ram 4 and the resultant force calculated therefrom can be resolved to determine the force Fx provided by the ship on the mooring robot in the athwartship direction. With reference to FIG. 4 upon the displacement of the vacuum cups 1 in the athwartship direction X such will result in a variation in the angle that the operational axis of the ram 4 makes with the athwartship direction X. The further the vacuum cups extend away from the wharf, the larger the angular displacement will be. However because the points of pivot between the fixed structure 113 and the moving structure 10 of the mooring robot are known, a measurement of the extension of the hydraulic ram will allow for the angle that the operational direction of the hydraulic ram 4 makes to the athwartship direction X. Simple calculations will allow for the hydraulic pressure 4 determined by the transducer 60 to be resolved for an athwartship direction force X. Similarly the mass of the components 100 swung about the pivot such as pivot 3 from the fixed structure can also be factored into the equation for resolving the pressure of hydraulic ram 4 into an athwartship force direction. The greater the extension of the ram 4 the greater the effect of the weight of the components 102 on the hydraulic ram 4 will be. Alternatively angular measurement means may be provided.

In the configurations of the mooring robots of FIGS. 19 to 23, where the rams to displace the vacuum pads in the athwartship direction remain parallel to the athwartship direction, no angular displacement of the rams occurs and no such additional steps to the calculations are necessary.

In addition to the determination of the athwartship direction forces between the mooring robot and the ship, it is advantageous to also know the longitudinal direction forces in direction Z between the mooring robot and the vessel. Such forces can trend towards inducing a shear between the vacuum cups 1 and the vessel 200. It is important that the shear direction force is resisted by ensuring that a strong vacuum is maintained between the vacuum cups and the vessel in order to prevent the vessel from moving in a longitudinal direction relative to the vacuum cups. If such movement occurred, a slipping of the vacuum cups relative to the vessel will result which is likely to ultimately lead to a disconnection between the vessel and the vacuum cups.

Similar to any movement of the vessel in an athwartship direction by the mooring robot, it is also important to know the forces between the vessel and the mooring robot when the vessel is being moved by the mooring robot in the longitudinal direction. It is important to ensure that the forces do not exceed a limit which is known to result in a shear failure of connection between the vacuum cups and the ship.

Figure 5:
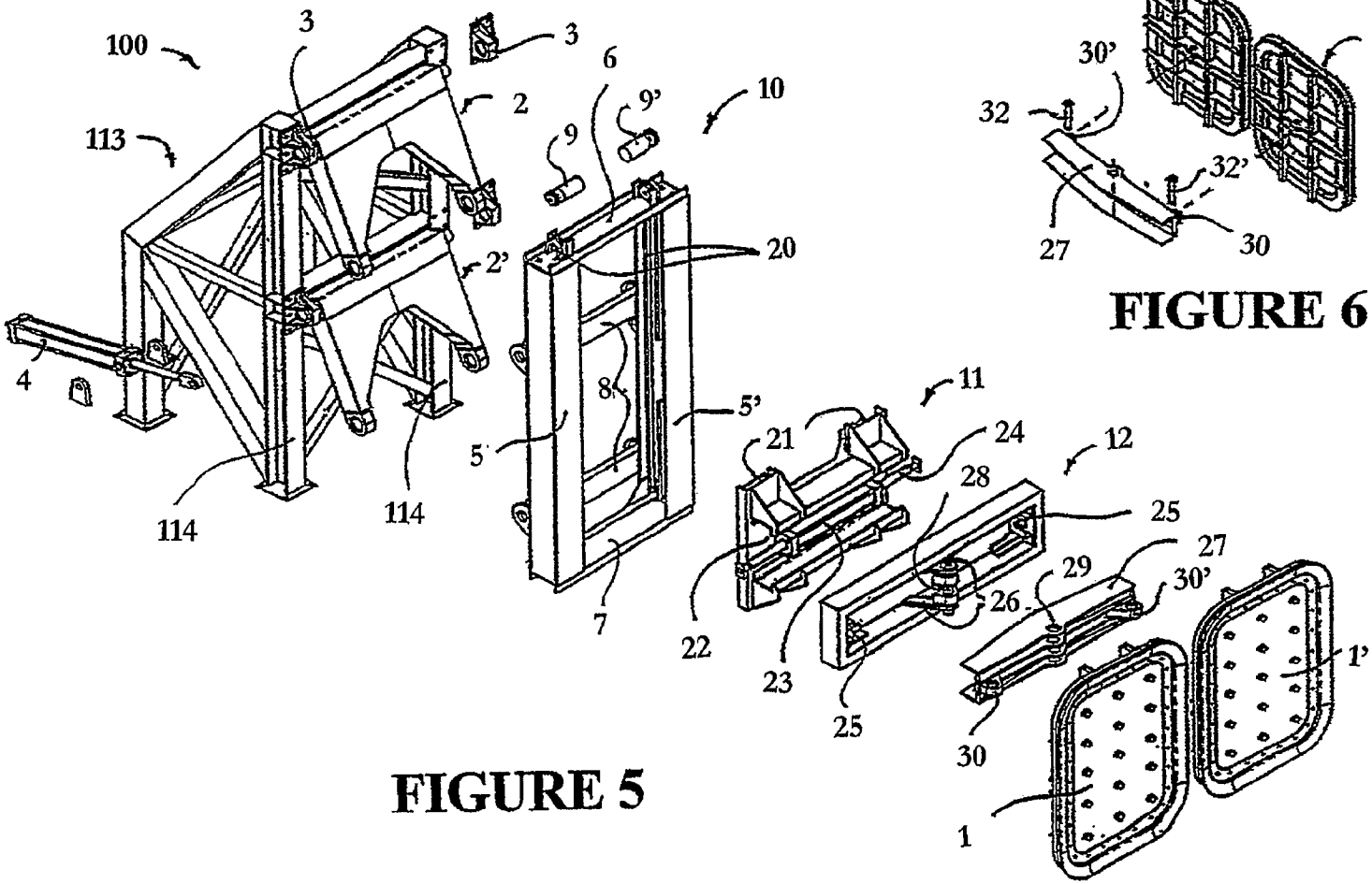
FIG. 5 is an exploded view of the mooring robot of FIG. 3.

In the mooring robot of FIG. 3 but with reference to the exploded view thereof shown in FIG. 5, the control of the positioning of the vacuum cups in the longitudinal direction is achieved by the ram 23. One part of the ram is engaged to the fixed structure of the mooring robot and the other is engaged to the structure movable with the vacuum cups in the longitudinal direction. Actuation of the ram 23 results in the displacement of the vacuum cups in the longitudinal direction.

Figure 26:
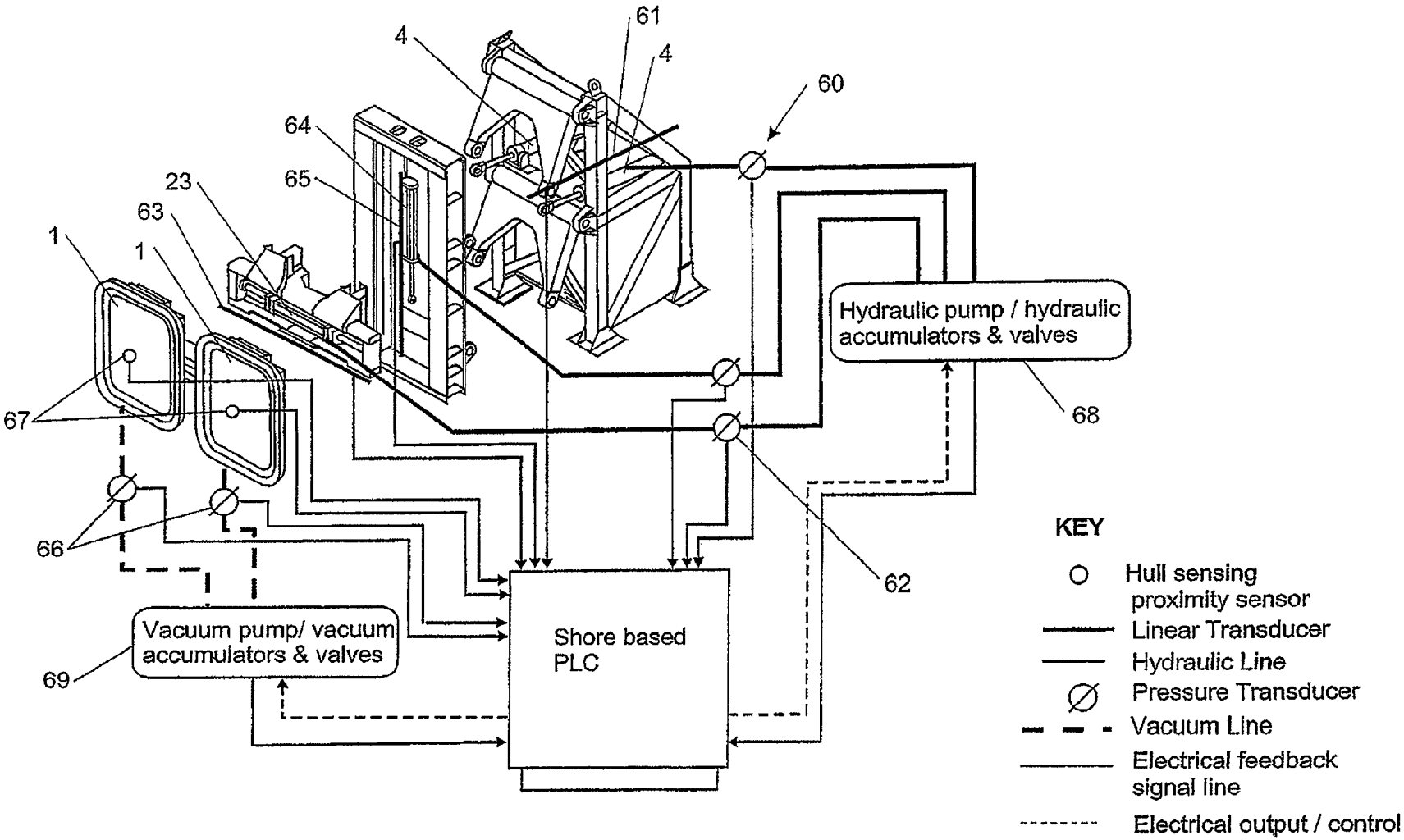
FIG. 26 is a schematic drawing illustrating the force and displacement measurement which may be provided at a mooring robot of the present invention.
Figure 27:
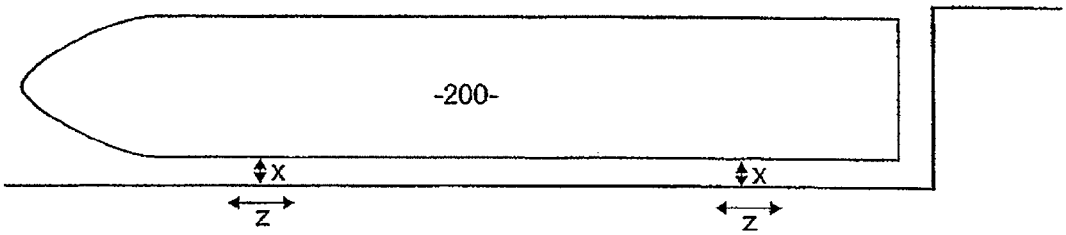
FIG. 27 is a plan view of a vessel adjacent a wharf illustrating the coordinates which may be measured by a mooring robot to determine the positioning of the vessel relative to the wharf.
Figure 28:
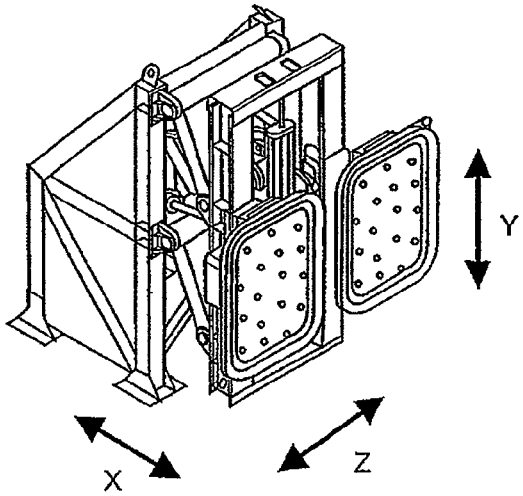
FIG. 28 is a perspective view of a mooring robot illustrating the directions axes of movement of the vacuum pads relative to the wharf.

In a manner similar to the measurement of force in the athwartship direction, a measurement of the force in the longitudinal direction can be made by the determination of the hydraulic pressure of the ram 23. With reference to FIG. 26, the pressure transducer 62 may be utilised for determination of the pressure to the hydraulic ram 23 to thereby allow for the determination of the force in the longitudinal direction Z. In the configuration of mooring robot as shown in FIG. 3, the ram 23 remains in all conditions, acting in a direction parallel to the longitudinal direction. Accordingly the pressure determined by the pressure transducer 62 will remain proportional to the longitudinal force applied by the ship to the mooring robot. No non alignment factors of the ram relative to the longitudinal direction Z need to be taken into consideration in the preferred configuration.

The pressure detected by the pressure transducer 62 is preferably fed to a processing unit for the purposes of calculation and evaluation and monitoring and comparison. More detailed reference will hereinafter be made to such monitoring and control.

The hydraulics to actuate the displacement of the ram 23 may (likewise to the ram 4) be cut into an accumulator loop of the system where it is desired and/or appropriate for the hydraulic ram 23 to operate in a passive mode. In such a passive mode the hydraulic ram will operate akin to a spring to any movement of the vacuum cups in the longitudinal direction Z. A lineal transducer 63 is preferably provided to determine the displacement of the vacuum cups in the longitudinal direction relative to the fixed structure of the mooring robot. The linear transducer will feed back the displacement information to the processing unit which may be configured to control the actuation of the ram 23 where for example the displacement of the vacuum cups is close to specified limits. In such a situation the hydraulics to the ram 23 may be cut out of the accumulator loop and into a pump loop to increase the hydraulic pressure to the ram 23 appropriately to ensure the maintenance of the displacement of the vacuum cups in the longitudinal direction to within desired limits.

With reference to FIG. 26 it can be seen that a similar hydraulic pressure measurement may be made of the rams 64 actuating the movement of the vacuum cups in the vertical direction however such measurement is less consequential since as has been before described, in operation the mooring robot will allow for such vertical movement to be substantially free from hydraulic control by the rams 64. A linear transducer 65 is preferably also provided between those fixed components of the mooring robot and the components moving in the vertical direction to position the vertical displacement of the vacuum cups to determine the positioning of the vacuum cups relative to the fixed structure of the mooring robot. Shear direction force in the vertical direction may hence also be measured.

With reference to FIGS. 7 to 10 it can be seen how the forces Fx and Fz measured as a result of hydraulic pressures on the rams 4 and 23, may be utilised for determining an overall force on the mooring robot Fxz. Likewise where in addition to the measurement of the hydraulic pressure in rams 4 and 23, pressure is also determined for the purposes of calculating the force applied by the ram 64, the force Fxyz may be determined as a vector sum of the forces Fx, Fy and Fz as for example shown in FIGS. 11 to 14. However the components of the total force in the Fx, Fz (and preferably but less importantly Fy) are determined more importantly for the purposes of ensuring that the known limits of the vacuum cups in each of the component directions is not exceeded. The holding force of the vacuum cups in the directions X and Z can be easily determined (whether mathematically or empirically) and the forces acting in such component directions need to be known to ensure that the ultimate limits of such holding force are not reached.

The vacuum pressure of the vacuum cups is preferably also determined by pressure transducers 66 as for example shown in FIG. 26 and such pressure information is fed back to a processing unit for the appropriate processing.

Figure 37:
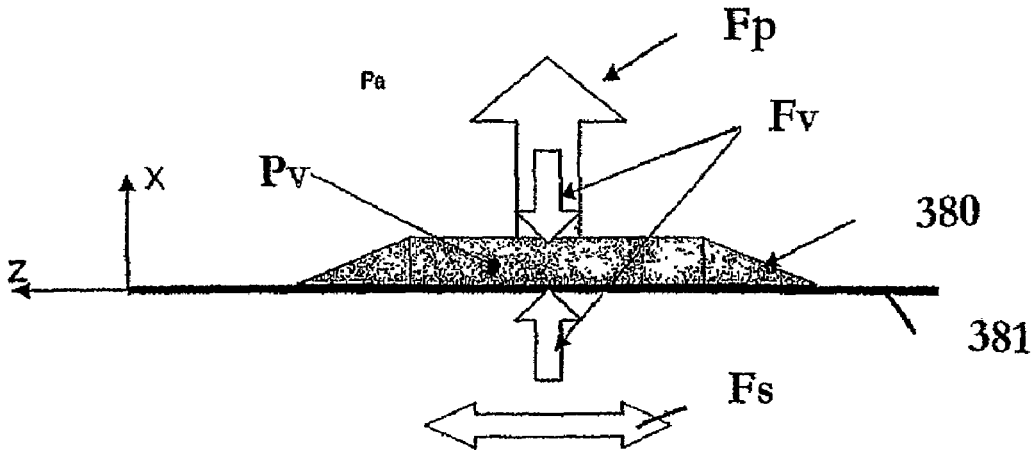
FIG. 37 is a force diagram to illustrate the shear force/tensile force relationship the mathematics of which will hereinafter be described.

With reference to FIG. 37 there is shown a force diagram to illustrate the relationship between the shear force and the vacuum couple force. The vacuum pad 380 is engaged to the ship hull 381. In FIG. 37 the nomenclature defines the following:

Fp=pull of force between ship and fixed structure of mooring robot;

Fv=vacuum couple force;

Pa=atmospheric pressure;

Pv=vacuum pressure; and

Fs=available shear force capacity.

With reference to FIG. 37 the vacuum couple force Fv=(Pa−Pv)×(effective suction area of vacuum cup).

The pull of force Fp=the force as measured as a factor of the in/out hydraulic pressure (or that determined from strain gauges or other).

Accordingly the shear force Fs capacity is a function remaining couple/normal Fn force and coefficient of friction m between the vacuum pad and ship hull. This may accordingly be expressed as:

Fn=Fv−Fp and

Fs=mFn.

The coefficient of friction m can be determined experimentally and will normally be determined during commissioning of the mooring system. A data table may be established for the shear force holding capacity over a range of Fv. Some variation will occur dependent on the characteristics of the surface which the vacuum pad will engage.

In addition to the monitoring of the force applied by the ship to the mooring robot in the athwartship direction X, the position of the ship relative to a fixed structure of the mooring robot and/or wharf is also determined. Where the ship moves relative to the fixed structure of the mooring robot beyond certain limits, the accumulator may be cut out of the hydraulic system of the ram 4 and pumps may be actuated appropriately to move and maintain the vacuum pads and hence the ship in the athwartship direction to a specified or within a range of limits of displacement. Such displacement may for example be measured by the measurement of the extension of the hydraulic ram 4 likewise longitudinal positional control may be exercised.

Known displacement measuring devices may be utilised for such purposes. Such may include optical or laser measuring components or linear transducers. There is currently also available a system that reads "marks" on a hydraulic cylinder shaft that works in much the same way as an electronic vernier. The measurement of displacement (e.g. by linear transducer 61) in the athwartship direction like the measurement of the hydraulic pressure by the pressure transducer 60 are fed to a central processing unit. With the knowledge of the displacement of the vessel in the athwartship direction relative to the fixed structure of the mooring robot and with the knowledge of the forces between the fixed structure of the mooring robot and the vessel, a significant degree of control and monitoring of the status of the vessel can be maintained by the mooring robot of the present invention Furthermore and with reference FIG. 26, hull proximity sensors 67 are provided which may be utilised during the preliminary stages of establishing a mooring contact between the mooring robot and the vessel so that sudden or large shock forces can be avoided during the application of the vacuum pads to the vessel. Proximity information provided by the hull proximity sensors 67 can be fed to the central processing unit to thereby control the positioning of the vacuum cups by the actuation of the hydraulic rams 4 and/or 23 and/or 64 appropriately for establishing a gentle contact between the vacuum cups and the vessel. Whilst in FIG. 26 the hydraulic pump/hydraulic accumulators and valves 68 have been shown generally a person skilled in the art of hydraulics provide such in an appropriate form. Similarly the vacuum pump/hydraulic accumulators and valves 69 have been shown generally in FIG. 26.

Figure 19:
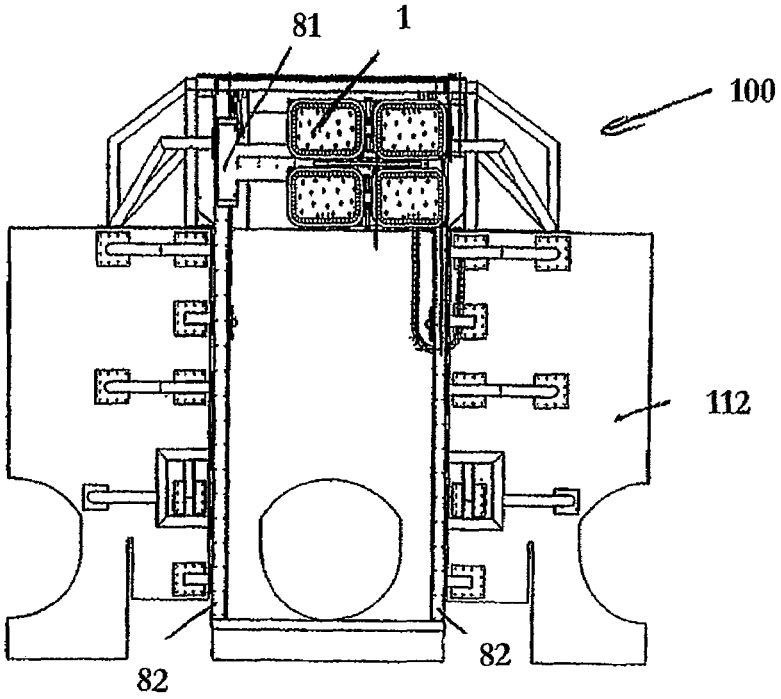
FIG. 19 is a front view of an alternative configuration of mooring robot engaged to a wharf or pylon or dolphin type pile.
Figure 20:
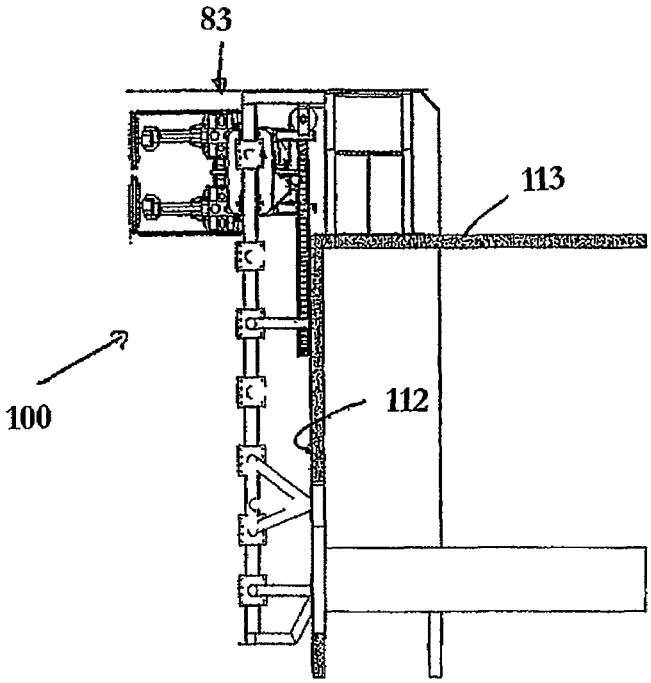
FIG. 20 is a side view of FIG. 19.
Figure 21:
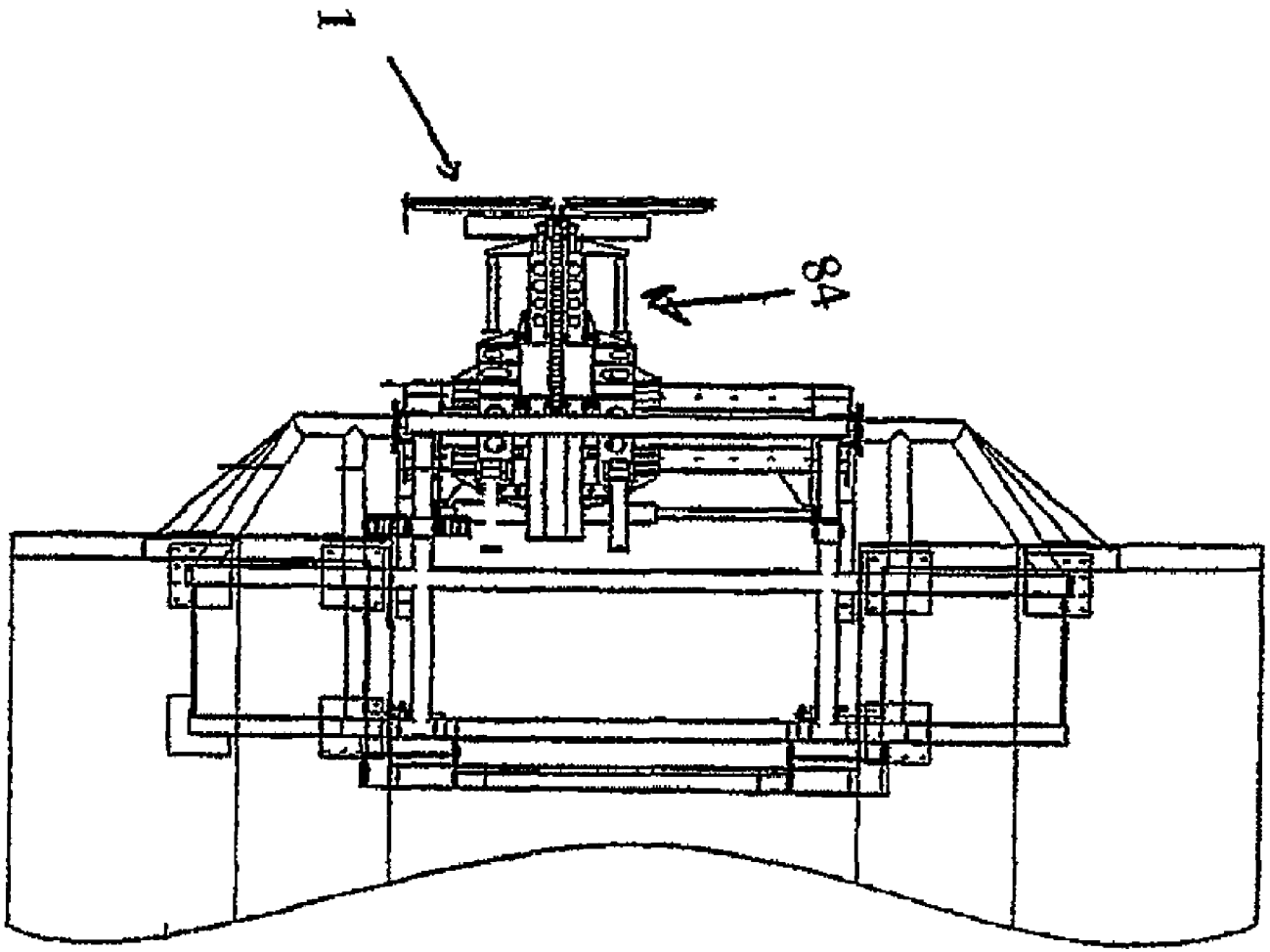
FIG. 21 is a plan view of FIG. 19.
Figure 22:
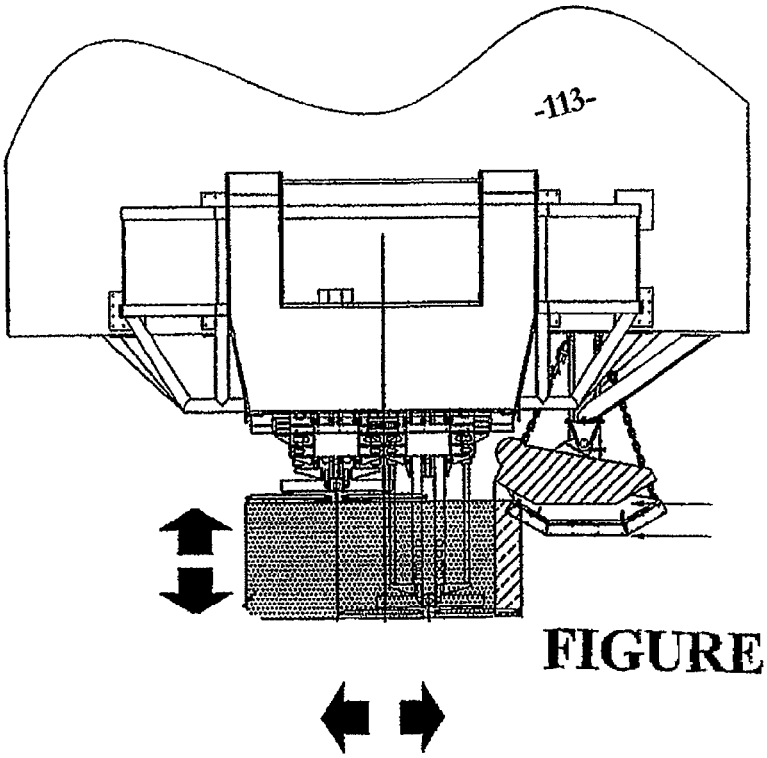
FIG. 22 illustrates a mooring robot of FIGS. 19-21 and wherein an additional fender is provided.
Figure 23:
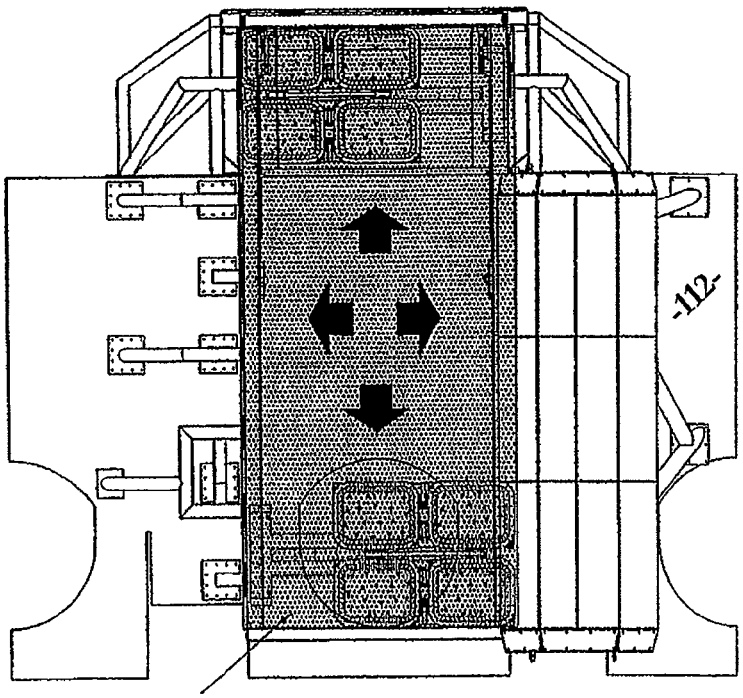
FIG. 23 is a front view of FIG. 22.
Figure 24:
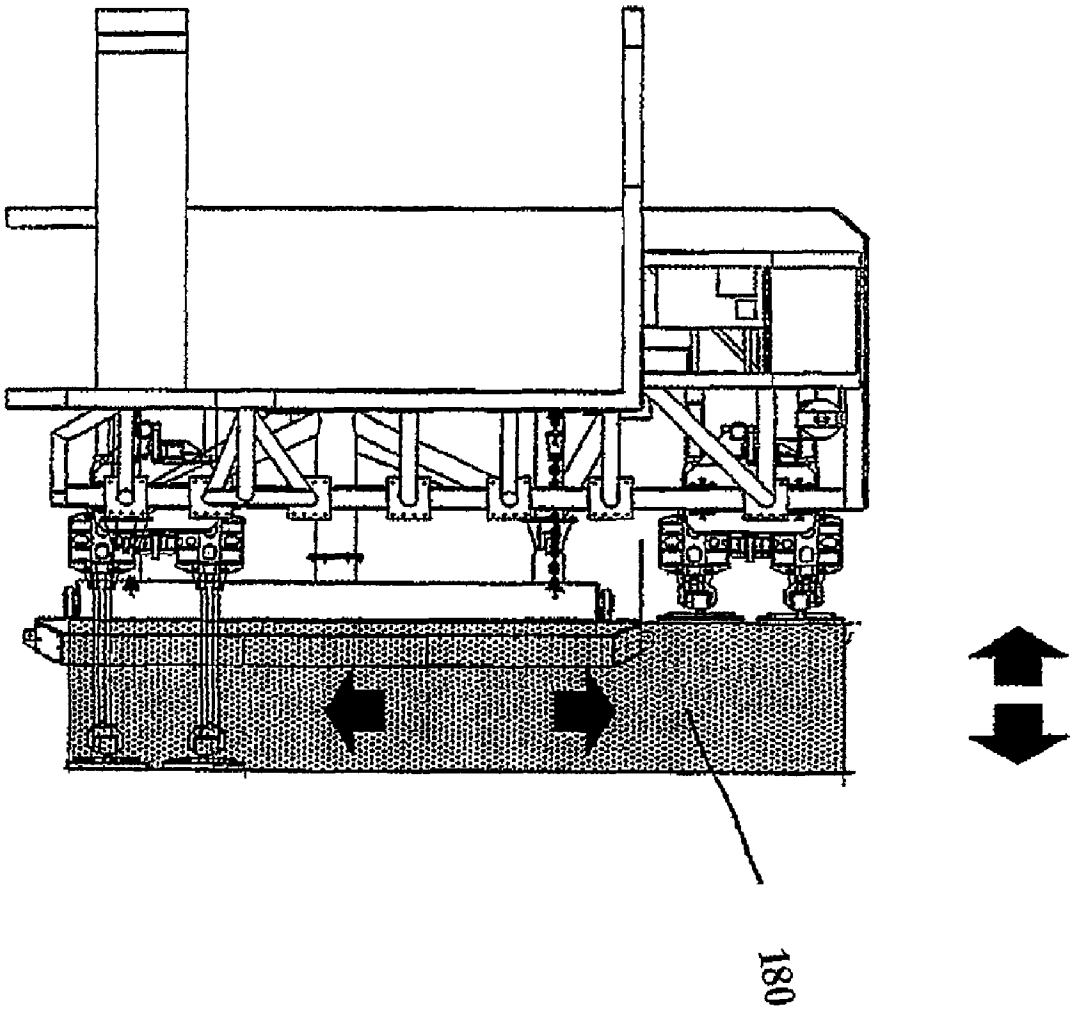
FIG. 24 is a side view of FIG. 22.

With reference to FIGS. 19 to 21 there is shown an alternative configuration of mooring robot 100. The mooring robot in this example comprises four vacuum pads 1 supported by a structure engaged to a wharf such as the front face 112 of the wharf and the deck 113 of the wharf. A vertical displacement carriage 81 is provided to mount the vacuum cups 1 from vertically extending rails 82 to allow the vacuum cups to travel in a vertical direction. A sub-carriage 83 is provided from the carriage 81 to allow the sub-carriage and hence the vacuum cups 1 to travel in a longitudinal direction and between the rails 82. Hydraulic rams and a supporting structure 84 are preferably provided to allow for the displacement of the cups 1 in an athwartship direction from both the carriage 81 and sub-carriage 83. Displacement of the vacuum cups 1 relative to the fixed structure of the mooring robot 100 as shown in FIGS. 19 to 21 is preferably provided in the athwartship direction by hydraulic rams. Likewise the movement in the longitudinal direction is provided by hydraulic rams. Movement in the vertical direction in this configuration may not necessarily be by hydraulic rams and may instead be by rack and pinion or similar arrangement to allow for the displacement of the vacuum cups in the vertical direction. The hydraulic rams to actuate the movement in the athwartship direction and in the longitudinal direction are preferably engaged to pressure transducers which (for the purposes and in a similar configuration as that described with reference to the mooring robot of FIG. 3) allow for the determination of the forces applied by the ship to the mooring robot in the longitudinal and athwartship directions. FIGS. 22 to 24 show by the shaded region 180 the degree of freedom of movement that can be achieved by the mooring robot of this configuration to position the vacuum cups within the envelope 180.

Figure 35:
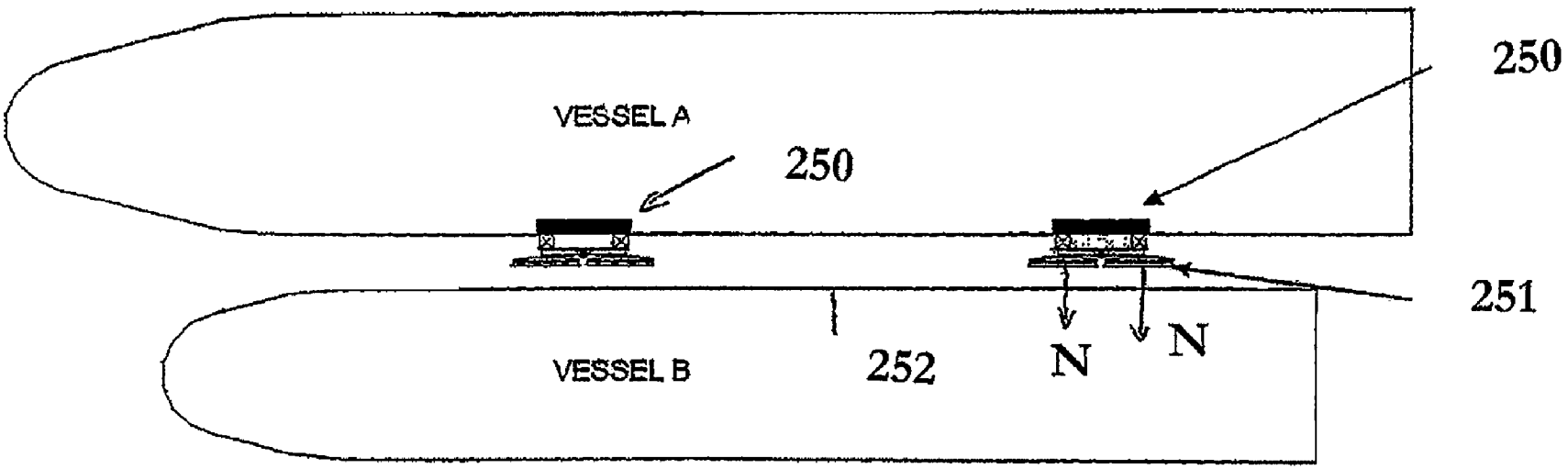
FIG. 35 is a plan view of two vessels positioned adjacent each other and wherein vessel A has affixed two mooring robots with which vessel B can become engaged.

FIG. 35 illustrates two mooring robots 250 engaged to vessel A in a permanent manner and wherein vacuum cups 251 are disposed from the side of vessel A to be presented for engagement with vessel B. In the most preferred form the vacuum pads extend in a condition such that the suction force N is substantially horizontal and normal to the surface 252 of the vessel B against which the vacuum cups 251 are to engage. In the most preferred form the vacuum cups are to engage with a substantially vertically extending surface of vessel B.

Figure 31:
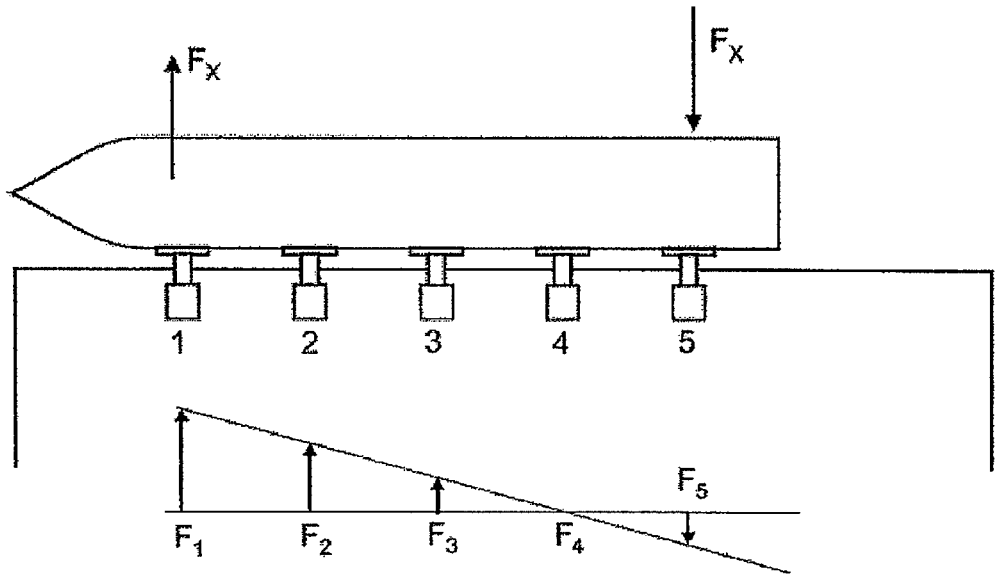
FIG. 31 is a plan view of a ship more adjacent a wharf with a plurality of mooring robots engaged to the hull of the vessel and wherein there is also illustrated the distribution of force applied by each mooring robot between the vessel and the mooring robots.

With reference to FIG. 31, in certain situations the load distribution between the plurality of mooring robots may not be equal. Indeed it may be that one mooring robot is at or approaching its maximum tensile force holding capacity. The system can be operated or may operate automatically in such conditions to provide for a redistribution of individual loads amongst the plurality of mooring robots. With reference to FIG. 31 it can be seen that the magnitude of athwartship direction forces in those robots towards the bow of the vessel are greater than those towards the stern. This may be as a result of differential wind or tidal flow loading and is quite conceivable in a given mooring facility. It may be that part of an offshore breeze is blocked by a large building on the wharf and wherein the bow of the vessel is subjected to high wind loading to force the bow away from the wharf. With the provision of monitoring of the forces on all mooring robots a loading profile can be established as a factor of distance along the wharf. With reference to FIG. 31 a redistribution of loading on individual robots can be achieved by for example increasing the athwartship direction force towards the wharf by mooring robots 2 and 3 to thereby reduce the load in the athwartship direction from mooring robot 1. Such redistribution of forces by the movement of an individual mooring robot in the athwartship direction as for example towards the wharf, may also be accompanied by an increase in the vacuum force of the vacuum cups of the mooring robot. In the example of FIG. 1, where the mooring system includes at least two mooring robots for engagement proximate more to the bow of a vessel and at least to mooring robots for engagement proximate more to the stern of the vessel, and where the athwartship direction force applied to one mooring robot in the aft set of mooring robots exceeds a threshold, and both robots in the aft set have the same holding capacity, then the athwartship force measured on the other mooring robot of the aft set is increased by actuation of the robot to evenly distribute the respective athwartship forces exerted by each robot Similarly a load profile in the longitudinal direction of each of the mooring robots can be determined. It may be that one mooring robot is reading a force in the longitudinal direction between the vessel and the mooring robot which is approaching the shear force holding capacity of the vacuum cup of such a robot. Where adjacent robots of the mooring system are in operation within the limits of the shear force direction holding capacity of their respective vacuum cups, such other robots may be moved in a direction to reduce the load in the longitudinal direction of the mooring robot approaching its shear force direction holding capacity. Such movement may be in conjunction with an increase in vacuum pressure to also increase the shear force holding capacity.

Knowing all the inputs from the data collected by the system, a PLC is able to control and/or distribute the shear/longitudinal capacity of each unit. As Fp may vary from unit to unit (see for example FIG. 31) the system optimises pressure in the longitudinal direction (Z direction) of the hydraulic cylinders to provide the best holding force in the Z direction over all units. Such can also occur in conjunction with the holding of the vessels into the fenders 50 where the capacity Fn allows.

As shown in FIG. 1, a mooring system in the illustrated embodiment includes two pairs of mooring robots 100 each having an independent hydraulic and vacuum supply, the robots 100 being installed between energy-absorbing fenders 50 placed at intervals along the front face of the dock 12. The system may be operated or may automatically operate in a manner such that if the force applied to the robots 100 has a longitudinal component exceeding the limits towards holding capacity in the Z direction, the robots 100 are controlled to press the hull of the vessel 200 to engage the fenders 50. In other words, as the shear force begins to reach capacity and there is enough holding capacity in the athwartship direction, the units may retract the vessel into the fenders to give a greater friction holding capacity in the longitudinal direction and hence increase the shear holding capacity of the system. As this will have an effect of decreasing the athwartship capacity, the use of this process may be fairly limited.

Some mooring facilities may only require the use of one mooring robot at or towards the bow or stern of a vessel and wherein the other end of the vessel is retained relative to a wharf or facility by other means. For example roll on roll off ships may often be moored in respect of a facility where the stern of the vessel where the roll on/roll off bridge is normally provided, in a slot region defined by the wharf. Since this portion of the ship is captured within such a slot region it may not require any further mooring at such a region of the ship and it may be that the bow or towards the bow of the ship, a mooring robot of the present invention is provided. Such is also for example shown in FIG. 36.

In terms of the monitoring and control of the system, each of the mooring robots 100 is connected by a link (e.g. wireless) to a remote control unit mounted aboard the vessel 200. The remote control transmits a signal to each mooring robot 100 to control its position and operation, and receives feedback of actual position forces and vacuum pressures including the magnitude and direction of the mooring loads in at least the athwartships direction. By displaying this information at the bridge of the vessel the master is able to take actions to reduce or redistribute the loads and also receives instant feedback upon the effects of these actions.

Under most conditions the operation of the mooring robots 100 is coordinated, for example, when mooring and unmooring the ship, or when performing vertical or horizontal stepping movements, as described in WO 0162584 which is hereby incorporated by way of reference. Monitoring of hydraulic pressures in the rams 4, 23 and vacuum in the vacuum cups 1, 1' allows the performance of the system to adjusted to attain optimum use of each mooring robot 100.

Figure 29:
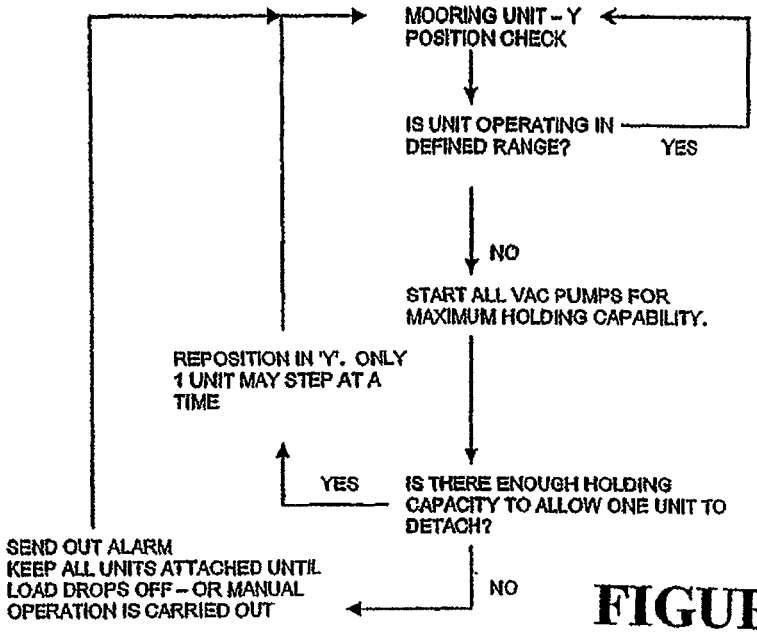
FIG. 29 is a flow diagram illustrating aspects of the control.

Under normal conditions when the mooring robot 100 approaches the extent of its vertical travel the system initiates a stepping sequence moving each mooring robot 100 alternately in a stepwise manner, however in this highly loaded state, stepping is prevented to ensure security of the vessel. With reference to FIG. 29, there is shown a basic control loop outlining the process for repositioning a unit in the vertical, if the system has to be moved out of range in the Y direction (i.e. vertical stepping). It will be observed that if the load is too great to allow for a mooring robot to detach, then no detachment will occur. Instead an alarm will be sent to the ship/shore personnel who will then take the appropriate action.

The total mooring force applied to the vessel 200 by each robot 100 when the hull is free from the fenders 50 is the sum of the athwartship and longitudinal components as measured through the transducers fixed to the rams 4 and 23 respectively. By knowing the magnitude and direction of this total mooring force the master is able to determine the best response to any situation.

Preferably time varying behaviour of the vacuum in the vacuum cups and the mooring loads and directions as determined from the pressure measurements made at the rams 4 and 23 are monitored and recorded. Other data is also monitored and recorded, including the position of the vacuum cups. Optionally, environmental measurements of wind and current speed and direction may also be simultaneously monitored and recorded, allowing vessel-specific data to be accumulated for load prediction.

Thus, certain embodiments provide complete automation of the mooring process without requiring manual adjustment to be made involving human input. The system allows the measurement of the displacement of the ship when engaged with a mooring robot or robots to allow the determination of the distances moved from a pre-programmed reference position and thereby allowing such distances to be compared with user defined tolerances. The system provides for means of counteracting the longitudinal and athwartship forces by the use of hydraulic actuators which can be actuated in response to information provided by the linear transducers to thereby revert the ship to its original position or to within a predefined displacement envelope. The system also provides for means of actively guiding the ship into a pre-programmed position or a repositioning the ship to a different position. The ships may often be required to move along a wharf in relation to a shore ramp, bulk loading/discharge devices or container gantry cranes during their stay in port. The present invention allows for such displacement to occur and for full control over both the positioning and the degree of fastening of the ship with the mooring robots to be determined and maintained. Athwartship direction control of the vessel by the system of the present invention is also important for the purposes of keeping the hull away from fenders and other wharf structures thus reducing the contact damage which may result in paint abrasion and mechanical wear.

The system allows for the ongoing measurement of forces acting on the ships hull as a result of tidal flow and wind loading in several planes directly. In addition the system may allow for the vertical forces to be determined and vertical travel to be determined. Combining some or all of the values that may be measured by the system of the present invention will allow for the overall forces and displacements to be continuously and immediately calculated and monitored. An alarm is indicated when the system is approaching its holding capacity as determined by the tensile loads in each robot approaching the holding capacities of their respective vacuum cups, thus allowing the ship's captain to take emergency action. Optionally the master may set an "alert" at some level below this alarm level.

For the purposes of ensuring that an integral connection between the wharf and the vessel is maintained, such information can also be useful for statistical analysis and may be correlated for determining environmental conditions such as wind and swell conditions which may in future be utilised for configuring the particular mooring facility or other mooring facilities of the present invention for the particular ship. With the knowledge of weather conditions and having collected statistical information on the mooring behaviour of a particular vessel in a particular port, the mooring system of the present invention to be configured in a manner suitable for future mooring the particular ship in particular environmental circumstances. It will be appreciated that some ships will be subject to higher loading forces as a result of having higher windage characteristics. A particular mooring system may be configured prior to receiving a ship from which previous data has been collected, to a condition which is going to be suitable for maintaining an integral mooring relationship with the vessel dependent on the environmental conditions in existence at the time of initial mooring. The system can accordingly allow for the generation of a database on historical environmental scenarios and the consequences thereof for a particular ship which may in future be used for the appropriate initial configuration of the mooring system during the initial mooring phase of the vessel. It may for example be known that in a 20 knot offshore breeze the tensile loading that the ship will subject to the mooring robot will require for the vacuum cups to operate at 90% which may be outside of the initial standard operating conditions of the vacuum cups. With the knowledge of wind speed in a subsequent mooring of the vessel at the mooring facility the vacuum cups can be configured to immediately operate at 90%. The system may be configured so that ship personnel can have full autonomy over the system. Displacement and force information of each mooring robot as well as a total loading and displacement condition may be monitored as well as presented graphically by the system of the present invention. An alarm system, and continuously monitored data is displayed using bars or other graphic illustrations on a computer screen displaying the magnitude of force and displacement of the total mooring facility as well as those on individual robots.

Whilst to a large extent reference herein is being made to a mooring robot it is to be appreciated that the vessel in all likely circumstances is to be secured to the wharf by at least two mooring robots at least one preferably provided at each end or towards each end of the vessel. Data obtained from the relationship of the vessel between each mooring robot can be collected and combined where necessary to provided an overall mooring status.

Figure 32:
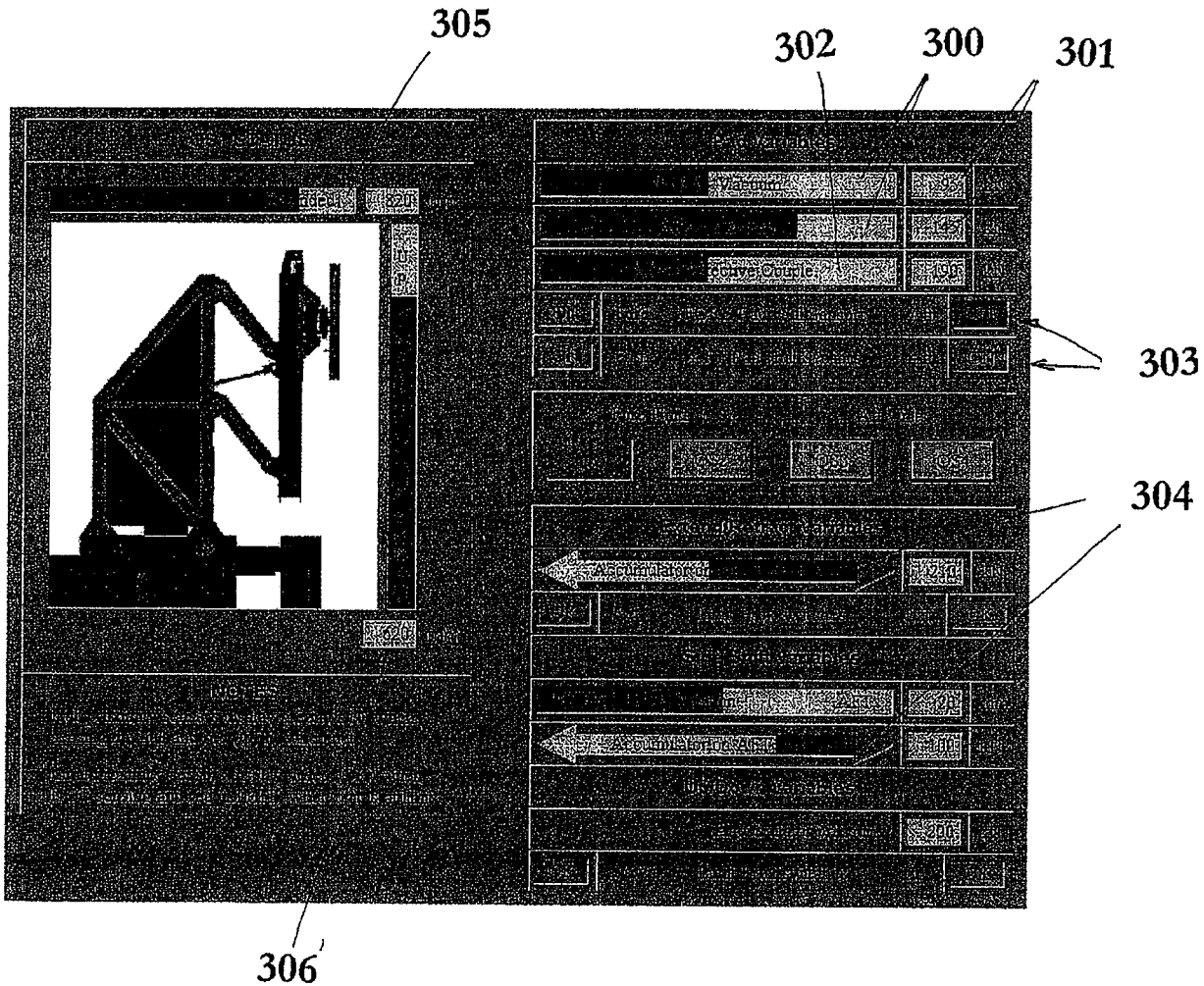
FIGS. 32 to 34 show some screen shots as part of the system.
Figure 33:
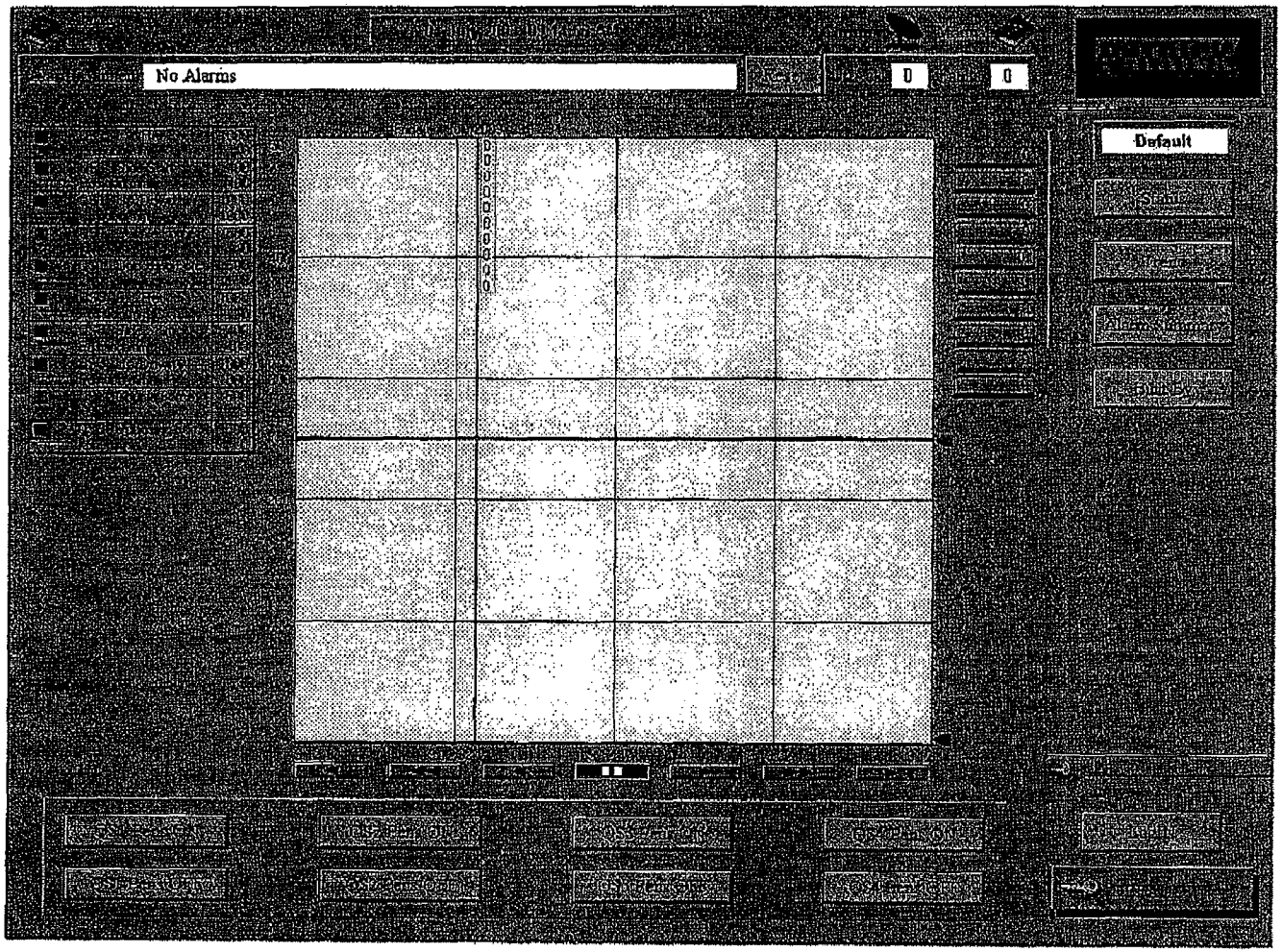
Figure 34:
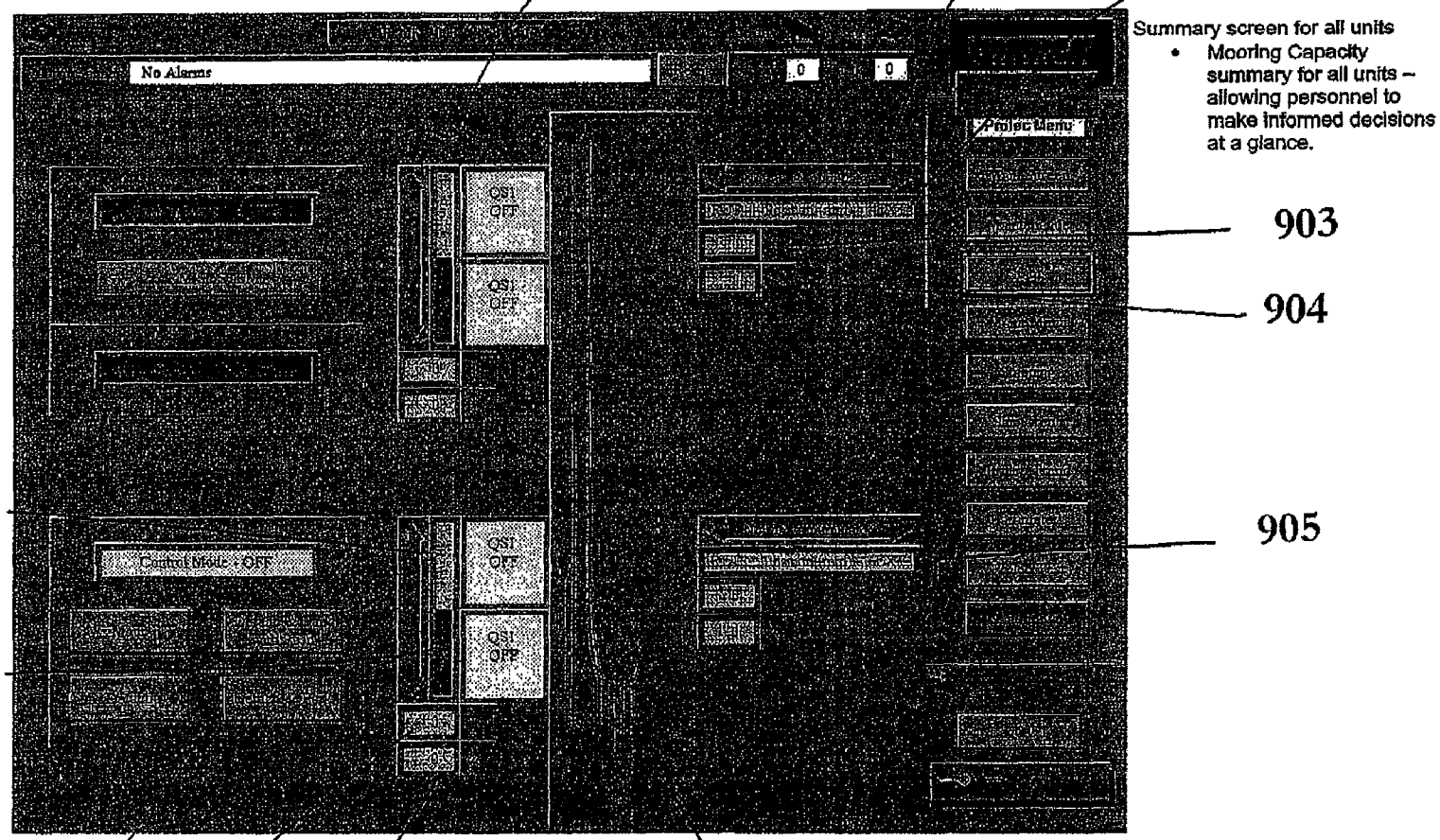

The collected data is preferably presented graphically. FIGS. 32 to 34 illustrate a screen shot which is indicative of the kind of information that may be displayed as part of the present invention.

FIG. 32 is a unit status support screen shot providing unit performance and particulars. The summary screen for each unit displays the loads in the X, Y and Z directions, the load capacity, the position in X, Y and Z, hull distance sensing data and vacuum levels. Regions 300 of the screen shot illustrate bar graphs of the vacuum levels in each pad of the mooring robot, regions 301 illustrate numerically the vacuum levels in each pad, region 302 is a bar graph of the unit holding capacity that remains and adjacent that is the corresponding numerical value. Regions 303 are illustrative of the pad proximity sensor status wherein there are two proximity sensors per vacuum pad. Regions 304 illustrate the force unit that is applying to the ship by the mooring robot. Region 305 illustrates the extension of the mooring robot in positioning the vacuum pads in the athwartship direction and region 306 illustrates the up and down displacement of the vacuum cups. The graphic bars illustrating the displacement and forces can be colour coded and change colour from green to orange to red as they approach predefined limits for that particular parameter. The system may have such limits pre-programmed and/or may allow for adjustment of such variables. In FIG. 32, QS1, QS2, QS3 and QS4 relate to the four mooring robots which are provided along the wharf for the purposes of mooring the vessel with the wharf. By clicking on the button for the respective unit, data for that particular unit will display.

FIG. 33 is a screen shot for displaying recorded data of a mooring robot for the entire mooring system, over time. Force and pressure variation of one or more mooring robots or of the entire vessel relative to the wharf may be displayed. As well as displaying data from each individual unit, a summary screen as for example shown in FIG. 34 may be provided for showing the mooring capacity as a summary of all units allowing personnel to make informed decisions at a glance. Furthermore the screen shot of FIG. 34 illustrates in region 310, buttons which may perform a sequence of tasks.

Region 901 may illustrate the force units 1 and 2 applying to the ship in the athwartship direction, region 902 may show the units 1 and 2 athwartship position, region 903 may show units 1 and 2 athwartship loading in metric tonnes.

Region 904 may show the units 1 and 2 percentage of athwartship holding capacity used, regions 905 may illustrate the same information as regions 901 to 904 but for units 3 and 4. Region 906 is a graphic of the berth, region 907 illustrates units 3 and 4 percentage of fore/aft holding capacity used, region 908 illustrates units 3 and 4 fore/aft loading in metric tonnes.

Region 909 illustrates units 3 and 4 forces that are applied to the ship in the fore/aft direction, region 910 illustrates unites 3 and 4 fore and aft position. Region 911 illustrates information in respect of units 1 and 2 corresponding to those similar of regions 907 to 910.

Figure 30:
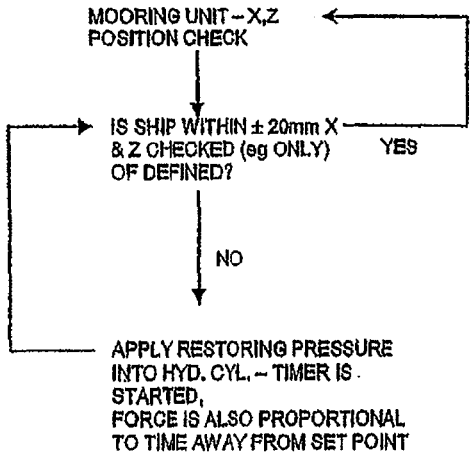
FIG. 30 is a flow diagram illustrating aspects of the control of the system.

With reference to FIG. 25, which shows a schematic of the preferred arrangement of components for the system of the present invention, it can be seen that data collected from the mooring robots is processed by a shore based PLC. The PLC may be connected to an industrial PC for further processing of data and/or control of the system via the PLC. A radio link to the ship may be provided from the shore based component of the system of the present invention although as an alternative, such a link may be a hard wired link. Data collected by the shore based PLC can in such a way be transmitted to the ship where display of the information processed by the shore based system and or further processing of the data from the shore based system may occur. A ship based PLC and/or PC may provide any additional processing and allow for relevant information to be displayed. Any input from either the shore based or ship based PC can be transmitted to the shore based PLC for the active control over both the positioning and forces that are applied by each individual mooring robot and vacuum at the vacuum cups to ensure a desirable connection is maintained between the mooring robots and the ship. In the most preferred form all feedback from the mooring units is communicated to the shore based PLC and then appropriate data is transmitted for display on the PCs on shore and ship. The PLCs evaluate feedback and then commands each unit to respond as required. Feedback includes linear position in the X, Y and Z directions from the linear transducers or similar device and/or forces in the X, Y and Z directions from the pressure transducers on each hydraulic cylinder. An alternative is to use strain gauges which may be positioned on the units in appropriate locations to determine forces. For example, FIG. 30 illustrates a flow diagram of a basic control loop for keeping the vessel in a defined moored range in the X, Z plane. If the vessel remains out of range for some time and the mooring units are reaching the limits of holding capacity and/or range of movement, alarms are sent to the ship/shore personnel. The athwartship force, vacuum attractive force and alarm signals may be transmitted (e.g. to a central monitoring station or the port authorities) for providing remote monitoring of the performance of the mooring robot.

The PLC converts information to a force reflective number and for display on the PCs. Vacuum levels in each vacuum pad and proximity information may also be processed and displayed graphically. Either the ship PC or shore PC may be used to control the mooring units with appropriate security on each. Macro control commands may be provided for and can include a) execution start up sequence when a vessel is arriving, b) mooring of the ship, c) detaching of the ship, d) detaching with a push to give the ship an initial momentum away from the berth when leaving, e) to move the vessel forward a defined distance, f) detach and park the units in a shutdown mode.

The system may also provide operational steps where there is a power loss to the system. In such a situation the system will remain attached to the vessel via the vacuum cups until the pressure inside the vacuum cups approaches atmospheric pressure hence the holding capacity decreases for example due to leakage of they system. The pneumatic and vacuum valves in the circuit may then return to their off state which has been designed such that the vacuum remains in the cup for the longest amount of time. In their off state the valves remove components from the circuit which may contribute to the leakage of the system, particularly the pneumatic and vacuum pumps. In the power loss mode the hydraulic accumulators will be cut into the circuit enabling the system to retain its flexibility and resilience in the X-Y plane. In this mode, the restoring force will be proportional to displacement only and not time.

The fact that the present invention utilises incompressible fluids and from which force measurements may be taken, a faster reaction time in terms of communicating information to and from the ship based computer can be provided for. Real time in absolute values of both forces and displacement can be provided by the system of the present invention.

Whilst the system may operate to control the position of the mooring robots in a continuously active mode, some time averaging responses to the control of the actuators may be a more appropriate form of control of the mooring robots. In such manner a continuously active control over the mooring robots need not be provided and control may only be provided at such stages where displacement of the vacuum cups from a predetermined norm occurs for any specified time period before active control over the vacuum cups to restore these two within the displacement range occurs.

The invention claimed is:

1. A method of controlling a vessel mooring system said system including at least one mooring robot for releasably fastening a vessel floating at the surface of a body of water to a terminal, the mooring robot including an attractive force attachment element displaceably engaged to a base structure of said mooring robot said base structure affixed to said terminal, said attractive force attachment element being releasably engagable with a vessel surface for making fast the vessel with said terminal, the mooring robot providing active translational movement of the attractive force attachment element relative to the base structure to allow thereby the movement of a vessel in a direction selected from any one or both of (i) an athwartship direction, and (ii) a longitudinal direction, said method, after the associating of the vessel with the mooring system by allowing the vessel surface to be engaged by the attractive force attachment element and the establishing of an attraction between said vessel and said mooring robot, comprises;

(a) measuring the attractive force between the surface and the attractive force attachment element, for the purposes of determining a holding capacity dependent on the attractive force in at least one of (i) parallel to the attractive force direction, (ii) normal to the attractive force direction and horizontally, and (iii) normal to the attractive force direction vertical, (b) measuring the force between the attractive force attachment element and the base structure of the mooring robot at least in a direction selected from any one or more of (i) parallel to the attractive force direction, (ii) normal to the attractive force direction and horizontally and (iii) normal to the attractive force direction and vertical, (c) monitoring the relationship between the attractive force and the force(s) measured in (b), wherein an alarm is triggered when any one or more of the forces measured in (b), in a direction to tend toward allowing relative movement between the attractive force attachment element and the said vessel, approaches the attractive force dependent holding capacity in the direction to tend towards allowing relative movement of the attractive force attachment element with said vessel.

2. A method as claimed in claim 1 wherein the attractive force attachment element comprises a variable attractive force attachment element and the method further includes, when any one or more of the forces measured in (b) reach a predefined limit tending toward allowing relative movement between the variable force attractive element and the said vessel in a direction parallel to such force(s) measured, the controlling to increase the attractive force between the vessel surface and the variable attractive force attachment element in response to the force(s) measured in (b).

3. A method as claimed in claim 1 wherein the attractive force attachment element comprises a variable attractive force attachment element and the method further includes, when any one or more of the forces measured in (b) reach a predefined limit tending toward allowing relative movement between the variable force attractive element and the said vessel in a direction parallel to such force(s) measured, the controlling to increase the attractive force between the vessel surface and the variable attractive force attachment element proportional to the force(s) measured in (b).

4. A method as claimed in claim 1 wherein the attractive force attachment element comprises a variable attractive attachment force element and the method further includes, when any one or more of the forces measured in (b) reach a predefined limit tending toward allowing relative movement between the variable force attractive element and the said vessel in a direction parallel to such force(s) measured, the controlling by increasing of the attractive force between the vessel surface and variable attractive force attachment element when the force(s) measured in (b) reaches a maximum limit of a predetermined range.

5. A method as claimed in claim 1 wherein the force(s) measured in (b) between the attractive force attachment element and the base structure is continuously monitored and determined from a signal responsive to a transducer, wherein said signal responsive to said transducer is displayed on the vessel visually, to indicate the force(s) between vessel and the base structure of said mooring robot.

6. A method as claimed in claim 1 wherein said system included a plurality of spaced apart mooring robots, each presenting an attractive force attachment element to engage to a surface of said vessel and wherein the force(s) as measured in (b) between the attractive force attachment element and the base structure of each mooring robot is continuously monitored and determined from a signal responsive to a transducer, wherein said signal responsive to said transducer is displayed on the vessel visually, to indicate the force(s) between vessel and the base structure of said mooring robot.

7. A method as claimed in claim 1 wherein said system included a plurality of spaced apart mooring robots, each presenting an attractive force attachment element to engage to a surface of said vessel, wherein said method further includes, when any one or more of the forces measured in (b) of one of said mooring robots tends toward allowing relative movement between the attractive force attachment element and the said vessel in a direction parallel to such force(s) measured by such approaching a holding capacity of the attractive force attachment element in any such direction, at least one of the other mooring robots is controlled for movement of its attractive force attachment element relative to the base structure in a direction to vary the force between its attractive force attachment element and its base structure in a direction opposite to such said direction to thereby reduce the force in such said direction between the attractive force attachment element and its said base structure of said one mooring robot.

8. A method as claimed in claim 1 wherein said system included a plurality of spaced apart mooring robots, each presenting a variable attractive force attachment element to engage to a surface of said vessel, wherein said method further includes, when any one or more of the forces measured in (b) of one of said mooring robots tends toward allowing relative movement between the variable force attractive element and the said vessel in a direction parallel to such force(s) measured by such approaching a holding capacity of the attractive force attachment element in any such direction, at least one of the other mooring robots is controlled to increase its attractive force.

9. A method as claimed in claim 1 wherein the attractive force between each attractive force attachment element and the vessel surface is measured and a signal corresponding to the measured attractive force is transmitted for the purpose of its display on the vessel.

10. A method as claimed in claim 1 wherein the attractive force between said attractive force attachment element and the vessel surface is measured and a signal corresponding to the measured attractive force is transmitted for the purpose of comparison with the measured force(s) of (b), wherein an alarm is triggered when any one or more of the forces measured in (b) reaches a proportion of the holding capacity for relative movement between said attractive force attachment element and said vessel.

11. A method as claimed in claim 1 wherein the attractive force between said attractive force attachment element and the vessel surface is measured and a signal corresponding to the measured attractive force is transmitted for the purpose of comparison with the measured force(s) of (b), wherein the attractive force is increased when any one or more of the forces measured in (b) reaches a limit corresponding a force (holding force) required to result in relative movement between said attractive force attachment element and said element, which holding force is dependent on attractive force measured.

12. A method as claimed in claim 1 wherein the attractive force attachment element is of a kind to be engaged with a planar surface of said vessel with its attractive force acting normal only to said planar surface, wherein the attractive force between each attractive force attachment element and the planar surface is measured and a signal corresponding to the measured attractive force is transmitted for the purpose of comparison with the force measured in (b) (ii) wherein an alarm is triggered when such force in a direction to tend toward resulting in a relative movement of said attractive force attachment element and said vessel in the direction parallel to the force measured in (b) (ii), approaches the holding capacity of said attractive force attachment element with said vessel as determined from the measured attractive force.

13. A method as claimed in claim 1 wherein the attractive force attachment element is of a kind to be engaged with a planar surface of said vessel with its attractive force acting normal only to said planar surface and is of a variable attractive force attachment element, wherein the attractive force between each attractive force attachment element and the planar surface is measured and a signal corresponding to the measured attractive force is transmitted for the purpose of comparison with the force measured in (b) (ii) wherein when such force in a direction reaches a predefined limit tending toward resulting in a relative movement of said attractive force attachment element and said vessel in the direction parallel to the force measured in (b) (ii), approaches the holding capacity of said attractive force attachment element with said vessel, the attractive force is increased.

14. A method as claimed in claim 1 wherein when the force between the mooring robot and the vessel parallel to the direction of force measured in (b) (i) tends toward resulting in a separation of said attractive force attachment element from said vessel, exceeds a first threshold the mooring robot adopts a safe mode wherein the attractive force between the vessel surface and the attractive force attachment element changes to a maximum attractive force.

15. A vessel mooring system which includes at least two mooring robots secured to a terminal, the terminal being either a fixed or floating structure each mooring robot including an attractive force attachment element displaceably engaged to a base structure of said mooring robot said base structure fixed relative to the terminal, said attractive force attachment element to be releasably engaged with a substantially vertically extending port or starboard side disposed vessel surface for making fast the vessel to said terminal, said attractive force attachment element capable of exerting an attractive force normal to said vessel surface at which it is to be attached, means to establish the attractive force between said vessel and said attractive force attachment element wherein each mooring robot includes means to actuate movement of the attractive force attachment element relative to the base structure in at least a direction selected from any one or both of an athwartship direction and longitudinal direction and wherein for each robot, said system further including (a) means to measure the attractive force between the attractive force attachment element and the vessel in a direction parallel to said normal to provide an "attractive force capacity reading" and (b) means to measure the force between said attractive force attachment element and the base structure of said mooring robot in at least any one or more of:

i. a direction parallel to the said normal to provide a "normal force reading"

ii. a direction horizontal and perpendicular to said normal to provide a "horizontal shear force reading", and iii. a direction vertical and perpendicular to the normal to provide a "vertical shear force reading"

(c) means to monitor the relationship between said attractive force capacity reading and any one or more of said normal force reading, horizontal shear force reading, and vertical shear force reading to provide a or several "mooring status reading(s)"

(d) means to control each mooring robot responsive to said mooring status reading(s) in a manner such that when any one or more of the normal force reading, the horizontal shear force reading, and the vertical shear force reading in a direction tending to allowing a relative movement between said vessel and said attractive force attachment element of a first of the at least two mooring robots, reaches a holding capacity of said attractive force attachment element in such direction, said means to control initiates at least one or more selected from the following:

i. inducing said means to establish said attractive force in a manner to increase said attractive force, ii. an alarm, and iii. a displacement of the attractive force attachment element of at least a second of the at least two mooring robots relative to its base structure, in a direction opposite to the direction tending to allowing a relative movement between said vessel and said attractive force attachment element of said first mooring robot, to increase a loading force on said at least second mooring robot and reducing a loading force on the first mooring robot in said direction tending to allowing a relative movement between said vessel and said attractive force attachment element of said first mooring robot.

16. A vessel mooring system as claimed in claim 15 wherein said attractive force attachment element comprises a vacuum pad or cup and said means to establish the attractive force between said vessel and said attractive force attachment element comprises a vacuum system in fluid communication with said vacuum cup and includes a vacuum generator.

17. A vessel mooring system as claimed in claim 15 wherein at least two mooring robots ("bow set") are provided to be engaged proximate more to the bow of a said vessel and at least two mooring robots ("stern set") are provided to be engaged proximate more to the stern of said vessel, wherein said means to control can control the attractive force of each attractive force attachment element and in a manner wherein when the attractive forces applied to the vessel surface by at least one of said mooring robot of each set reaches a first threshold the means to control operates in a manner to normalise the attractive force of each robot of each set.

18. A vessel mooring system for mooring a first vessel, wherein the vessel mooring system includes at least two mooring robots secured to a terminal, the terminal being either a fixed or floating dock (or a second vessel) each mooring robot including an attractive force attachment element engaged to a base structure of said mooring robot said base structure fixed relative to the terminal, said attractive force attachment element to be releasably engaged with a vertically extending port or starboard slide disposed vessel surface for making fast the first vessel to said terminal, said attractive force attachment element capable of exerting an attractive force normal to said vessel surface at where it is to be attached, means to establish the attractive force between said first vessel and said attractive force attachment element wherein for each robot, said system further including (a) means to measure the attractive force between the attractive force attachment element and the first vessel to provide an "attractive force capacity reading" and (b) means to measure the force between said attractive force attachment element and the base structure of said mooring robot at least in a direction parallel to the said normal to provide a "normal force reading"

(c) means to monitor the relationship between said attractive force capacity reading and said normal force reading to provide a "mooring status reading"

(d) means to control the mooring robot responsive to said mooring status reading in a manner such that when the normal force reading in a direction tending to separate the attractive force attachment element from said first vessel reaches an attractive force reading threshold, said means to control initiates at least one of:

i. inducing said means to establish said attractive force in a manner to increase said attractive force, and ii. an alarm.

19. A vessel mooring system as claimed in claim 18 wherein each mooring robot includes means to actuate translational movement of the attractive force attachment element relative to the base structure in at least an athwartship direction and wherein said means to control may in addition initiate a displacement of attractive force attachment element of an other robot of said system in the athwartship direction towards its said base structure thereby increasing a loading force of said other of said mooring robots dependent on the other mooring robot having capacity determined from said attractive force capacity reading, to do so.

20. A vessel mooring system as claimed in claim 18 wherein said system further includes (a) means to determine a shear force holding capacity between said attractive force attachment element and said first vessel resultant from said attractive force capacity reading, in a horizontal direction and perpendicular to said normal, to provide a "shear force holding capacity reading"

(b) means to measure a shear direction force, being a force parallel to said shear force holding capacity, between said attractive force attachment element and said base structure of said mooring robot to provide a "shear force reading"

(c) means to monitor the relationship between said shear force holding capacity reading and said shear force reading to provide a "second mooring status reading"

wherein said means to control the mooring robot is also responsive to said second mooring status reading in a manner such that when the shear force reading in a direction tending to allowing relative movement of said first vessel and said attractive force attachment element, reaches a predetermined limit, said means to control initiates at least one or more selected from the following:

i. inducing said means to establish said attractive force in a manner to increase said attractive force, and ii. an alarm.

21. A vessel mooring system as claimed in claim 19 wherein said means to actuate translational movement of the attractive force attachment element comprises a linear actuator having an operation axis in the athwartship direction.

22. A vessel mooring system as claimed in claim 19 wherein said means to actuate translational movement of the attractive force attachment element is comprises a hydraulic linear actuator having an operation axis in the athwartship direction, said normal force measurement derived from means to sense the hydraulic pressure of said hydraulic linear actuator.

23. A vessel mooring system for controlling mooring of a vessel with a wharf facility said system comprising:

at least one mooring robot for releasably fastening to said vessel said mooring robot including i. a fixed structure fastened to said wharf facility, ii. an attractive force attachment element for releasable engagement via an attractive force with a generally planar vertical surface of the vessel, said attractive force attachment element moveably disposed from said fixed structure to allow its relative movement to said wharf facility in 3 orthogonal directions being a vertical direction, a first horizontal direction parallel to a normal of the vertical surface and a second horizontal direction parallel to the planar vertical surface iii. means to actuate movement of the attractive force attachment element in at least said first and second horizontal direction, means to generate a force signal representative of a force between the fixed structure and said attractive force attachment element in a direction parallel to said first horizontal direction, and means to generate a force signal representative of a force between the fixed structure and said attractive force attachment element in a direction parallel to said second horizontal direction, means to generate a force signal representative of a tensile holding force between said attractive force attachment element and said vessel in said first horizontal direction, means to determine a shear holding force between said attractive force attachment element and said vessel in said second horizontal direction, means responsive to said first and second mentioned means to generate a force signal, which when one or more of (a) the force measured by said first mentioned means to generate a force signal reaches a predefined value approaching the tensile holding force and (b) the force measured by said second mentioned means to generate a force signal reaches a predefined value approaching the shear holding force initiates any one or more selected from the following;

(a) an alarm and (b) induces an increase in the attractive force of said attractive force attachment element with said vessel and (c) induces the means to actuate movement to change acceleration/deceleration of said attractive force attachment element relative to said wharf facility in a direction to reduce an amount of force which is over said predefined value, wherein the amount of force which is over said predefined value comprises one or both of:

i. the force between the fixed structure and said attractive attachment element in the direction parallel to said second horizontal direction and ii. the force between the fixed structure and said attractive attachment element in the direction parallel to said first horizontal direction.

24. A mooring system for releasably affixing a vessel floating at the surface of a body of water to a terminal which is secured to the bottom of said body of water wherein said vessel is subjected to loading forces resultant from any one or more of wind, tides, water currents, waves, vessel loading levels, and movement actuated by said system, said system including at least one mooring robot which includes (a) a base structure affixed to one of said terminal or said vessel, (b) a variable attractive force attachment element engaged to said base structure, said variable attractive force attachment element adapted to become affixed to and establish an attachment with a surface of the other of said one of said terminal or vessel, said attachment being of an attractive kind establishing an attractive holding force normal to the surface at which it is to attach, means to determine the attractive holding force of said variable attractive force attachment element when said variable attractive force attachment element is in an attached relationship with said surface means to determine a shear direction holding force of said variable attractive force attachment element with said surface when said variable attractive force attachment element is in an attached relationship with said surface, said shear direction holding force being in a horizontal direction and perpendicular to a normal to the surface of the other of said one of said terminal or vessel, means to determine at least one or more selected from a group consisting of a. a tensile force applied by said surface to said variable attractive force attachment element in a direction parallel to said normal, and b. a horizontal shear force applied by said surface to said variable attractive force attachment element in a horizontal direction and perpendicular to said normal, and means for allowing comparison between i) the attractive holding force and said tensile force and ii) the shear direction holding force and said horizontal shear force.

25. A mooring system as claimed in claim 24 wherein said means for allowing comparison will initiate, when one or both of i. said tensile force reaches a predetermined limit being a limit below the attractive holding force but approaching said attractive holding force in a direction to tend towards the release of said variable attractive force attachment element with said surface, and ii. said horizontal shear force reaches a predetermined limit being a limit below the shear direction holding force by approaching said shear direction holding force in a direction to tend towards a relative movement in a horizontal direction between said surface and said variable attractive force attachment element, one or more selected from i. inducing the variable attractive force attachment element to vary said attractive force, in a manner to increase said attractive holding force, and ii. an alarm.

26. A mooring system as claimed in claim 24 wherein said means to determine the attractive holding of said variable attractive force attachment element when said variable attractive force attachment element is in an attached relationship with said surface includes a sensor responsive to force between said variable attractive force attachment element and said surface in a direction normal to said surface and means responsive to the signal from said sensor to determine an effective attractive holding force.

27. A mooring system as claimed in claim 24 wherein said variable attractive force attachment element is moveably engaged to said base structure by a linkage mechanism and there is provided means to actively actuate the movement of said variable attractive force attachment element relative to said base structure parallel to said horizontal shear force direction and parallel to said tensile force direction.

28. A mooring system as claimed in claim 24 wherein said variable attractive force attachment element is movably engaged to said base structure by a linkage mechanism and there is provided means to actively actuate the movement of said variable attractive force attachment element relative to said base structure parallel to said horizontal shear force direction and means to actively actuate the movement parallel to said tensile force direction wherein said means for allowing comparison may further initiate, when one or both of i. said tensile force reaches a predetennined limit being a limit below the attractive holding force but approaching said attractive holding force in a direction to tend towards the release of said variable attractive force attachment element with said surface, and ii. said horizontal shear force reaches a predetermined limit being a limit below the shear direction holding force but approaching said shear direction holding force in a direction to tend towards a relative movement in a horizontal direction between said surface and said variable attractive force attachment element, a change in velocity (acceleration or deceleration) of said variable attractive force attachment element by one or both of said means to actively actuate the movement in order for said at least one of tensile force and horizontal shear force to remain below their respective limits.

29. A mooring system as claimed in claim 24, further comprising means to control the attractive force provided by the variable attractive force attachment element.

30. A mooring system as claimed in claim 29 wherein said variable attractive force attachment element comprises a vacuum cup defining a pressure controllable cavity when engaged with said surface and wherein said means to control the attractive force includes vacuum inducing means which is in fluid communication with said cavity to control the pressure in said cavity.

31. A mooring system as claimed in claim 24 wherein said means to determine the shear direction holding force of said attractive force attachment element with said surface when said variable attractive force attachment element is in an attached relationship with said surface also determines the shear direction holding force (hereinafter "vertical shear direction holding force") in a vertical direction and perpendicular to said normal and wherein means to measure the force (hereinafter "vertical shear force") applied by said surface to said attractive force attachment element in a vertical direction and perpendicular to said normal is provided, for the purposes of comparison of said vertical shear direction holding force with said vertical shear force.

32. A mooring system as claimed in claim 31 wherein said means for allowing comparison will also initiate, when said vertical shear force reaches a predetermined limit being a limit below the vertical shear direction holding force but approaching said vertical shear direction holding force in a direction to tend towards a relative movement in a vertical direction between said surface and said variable attractive force attachment element, one or more selected from i. inducing the variable attractive force attachment element to vary said attractive force, in a manner to increase said attractive holding force, and ii. an alarm.

33. A mooring system as claimed in claim 24 wherein said means to determine the horizontal shear force and/or tensile force includes means to measure responsive to such force(s) and means to read said means to measure said means to read providing a signal useable by said means allowing comparison.

34. A mooring system as claimed in claim 24 wherein said means to determine the attractive holding force includes means to measure responsive to such force and means to read said means to measure said means to read providing a signal useable by said means allowing comparison.

35. A mooring system as claimed in claim 34 wherein said variable attractive force attachment element comprises a vacuum cup defining a pressure controllable cavity when engaged with said surface and wherein said means to control the attractive force includes vacuum inducing means which is in fluid communication with said cavity to control the pressure in said cavity, said means to measure responsive to said attractive force being a pressure transducer engaged with said mooring robot in manner to measure the pressure differential between the cavity of said vacuum cup and ambient atmospheric pressure.

36. A mooring system as claimed in claim 24 wherein said means to measure the said shear direction holding force means comprises means to calculate such shear direction holding force from said measured attractive holding force.

37. A mooring system as claimed in claim 36 wherein the means to calculate includes a table of empirically collected attractive holding force varying and dependent horizontal shear direction holding force reflective numbers reliant on which said shear direction holding force can be determined.

38. A mooring system as claimed in claim 29 wherein said means to actively actuate includes at least one hydraulic ram.

39. A mooring system as claimed in claim 29 wherein means to measure the displacement of said variable attractive force attachment element relative to said base structure is provided.

40. A mooring system as claimed in claim 29 wherein an alarm is sounded when one of more of the limits of movement of said variable attractive force attachment element relative to said base structure is reached.

41. A mooring system as claimed in claim 29 wherein the displacement of said variable attractive force attachment element relative to said base structure is visually represented.

42. A mooring system as claimed in claim 24 wherein said attractive forces are able to be controlled by human input.

43. A mooring system as claimed in claim 29 wherein said displacement is able to be controlled by human input.

* * * * *

UNITED STATES PATENT AND TRADEMARK OFFICE

CERTIFICATE OF CORRECTION

PATENT NO. : 7,293,519 B2
APPLICATION NO. : 10/522868
DATED : November 13, 2007
INVENTOR(S) : Montgomery et al.

It is certified that error appears in the above-identified patent and that said Letters Patent is hereby corrected as shown below:

Title Page, Col. 2 (Abstract)

Line 3, delete “eg.” and insert -- e.g. --

Column 4

Line 20, delete “force (s)” and insert -- force(s) --

Line 30, delete “force (s)” and insert -- force(s) --

Column 10

Line 45, after “attachment” insert -- element --

Column 11

Line 46, after “one” delete “of” and insert -- or --

Column 12

Line 29, delete “win” and insert -- will --

Column 14

Line 29, after “embodiment” insert -- the --

Line 31, delete “eg” and insert -- e.g. --

Column 23

Line 16, after “invention” insert -- . --

UNITED STATES PATENT AND TRADEMARK OFFICE

CERTIFICATE OF CORRECTION

PATENT NO. : 7,293,519 B2
APPLICATION NO. : 10/522868
DATED : November 13, 2007
INVENTOR(S) : Montgomery et al.

It is certified that error appears in the above-identified patent and that said Letters Patent is hereby corrected as shown below:

Column 24

Line 46, after "robot" insert -- . --

Column 35

Line 5, after "element" delete "is"

Column 37

Line 20, delete "predetennined" and insert -- predetermined --

Column 38

Line 50, after "one" delete "of" and insert -- or --

Signed and Sealed this

Fifth Day of May, 2009

JOHN DOLL
*Acting Director of the United States Patent and Trademark Office*